United States Patent [19]

Zilinskas

[11] Patent Number: 4,681,319

[45] Date of Patent: Jul. 21, 1987

[54] RACKET HAVING UNIQUE STRING MOUNT

[76] Inventor: Gene Zilinskas, 17536 Lemay St., Vay Nuys, Calif. 91406

[21] Appl. No.: 303,361

[22] Filed: Sep. 18, 1981

Related U.S. Application Data

[63] Continuation-in-part of Ser. No. 948,691, Oct. 5, 1978, abandoned, and a continuation-in-part of Ser. No. 1,941, Jan. 8, 1979, abandoned.

[51] Int. Cl.[4] ..... A63B 49/02

[52] U.S. Cl. ..... 273/73 D; 273/DIG. 23

[58] Field of Search ..... 273/73 D, 73 R, 127 D, 273/127 C, DIG. 23

[56] References Cited

U.S. PATENT DOCUMENTS

| | | | |
|---|---|---|---|
| 2,091,999 | 9/1937 | Madge et al. | 273/73 R |
| 3,702,189 | 11/1972 | Galich | 273/73 D |
| 3,873,097 | 3/1975 | Willis | 273/127 D |
| 4,070,021 | 1/1978 | Cecka et al. | 273/DIG. 23 |
| 4,185,822 | 1/1980 | Li | 273/73 D |
| 4,231,575 | 11/1980 | Kutt et al. | 273/73 D |
| 4,249,731 | 2/1981 | Amster | 273/73 D |

*Primary Examiner*—Richard C. Pinkham

*Assistant Examiner*—Matthew L. Schneider

*Attorney, Agent, or Firm*—Gilbert P. Hyatt

[57] ABSTRACT

A racquet is provided having a transverse compliant edge system that supports the racquet strings and has independent elastic transverse movement of the string supports while inhibiting accompanying radial movement. The transverse compliant edge system includes rigid string support rails inside an outer channel in the racquet frame. Each string support rail has an outer groove that contains and supports the racquet string and an inside contact surface supported by the racquet frame and that acts as a pivot point. The string support rails are spaced away from the walls of the outer channel in the racquet frame and the spaces are bridged with compliant material or springs. This arrangement allows the string support rail to rotate about its inside contact surface pivot, thus allowing elastic transverse string movement while inhibiting accompanying radial movement, independent of transverse string movement caused by the elasticity of the ball, strings, or racquet. This transverse compliant edge system enlargens the racquet's 'sweet spot', and increases the ball's dwell-time on the racquet; which improves the hitting power, ball control, and ability to spin the ball by the player using the racquet.

19 Claims, 38 Drawing Figures

RACKET HAVING UNIQUE STRING MOUNT

CROSS REFERENCE TO RELATED APPLICATIONS

The instant application is a continuation-in-part of copending parent patent applications (1) Racquet Stringer Arrangement and Method by Zilinskas Ser. No. 948,691 filed Oct. 5, 1978 and now abandoned and a continuation-in-part of (2) Racquet Arrangement and Method by Zilinskas Ser. No. 001,941 filed Jan. 8, 1979 and now abandoned;

wherein the benefit of the filing dates thereof are herein claimed in accordance with 35 USC 120 and other authorities therefore; and wherein said two parent applications are herein incorporated by reference.

BACKGROUND OF THE INVENTION

It has long been the practice to arrange string, cord, or line (hereafter referred to as string) across the loop formed by the racquet frame to provide a light, resilient surface (hereafter referred to as the strung surface) to hit balls or other objects with power and control. It is common to arrange the string, usually kept in tension, in a criss-cross weaved fashion across the racquet frame. The string is commonly supported directly by the racquet frame, or supported by flexible grommets, or a grommet strip mounted on the outside periphery of the racquet frame. The plurality of strings thus arranged forms the racquet's strung hitting surface.

Almost all tennis, squash, badminton, and racquetball racquets use hitting surfaces of string that is arranged in some manner across the loop formed by the racquet frame.

Racquet designers and manufacturers construct racquets with good playing characteristics. High string resiliency is often thought to improve a racquet's performance. Hence, much effort has been expended to provide strong resilient strings to achieve or improve high racquet performance. It is also common practice to vary stiffness of a racquet frame to control and improve a racquet's performance characteristics. Racquet stiffness can be controlled by the racquet manufacturer with the choice of racquet construction material, or by the internal or external configuration of the racquet, or by a combination of these techniques. Other approaches to improve a racquet's performance include the use of extra weights on parts of the racquet frame, or forming the racquet frame to a shape different than the common oval shape, or making the racquet frame larger for a large string surface, or supporting the strings on radially compliant springs or material, or a combination of these techniques.

The common approaches for improving a racquet's performance have drawbacks. For example, racquet power (the amount of energy imported to a hit ball) can be improved by increasing racquet stiffness. Unfortunately, high stiffness makes it more difficult to control direction of a hit ball, makes it more difficult to impart spin to a ball, and may cause a racquet to vibrate when hitting the ball especially with off-center hits. In another example, attempts to increase size of the 'sweet spot' (the region of high and most even rebound response) by making the area of the strung hitting surface larger, such as by increasing the size of the racquet frame loop or by attaching extra weights to the top or sides of the racquet frame, may be ineffective. Theory and experiments indicate that relatively little may be gained by these measures, while several draw-backs may appear. For example, a racquet's rotary inertia about its longitudinal axis (the line along the racquet's handle) may be increased, or the racquet may become top-heavy, thus reducing the quickness (maximum racquet head acceleration obtainable by a given player) and maneuverability of the racquet, which in turn detrimentally affects the racquet's overall power and control. In another embodiment, all of part of the racquet's strings may be supported on radially compliant springs or radially compliant material. This may gain some racquet performance benefits because the ball's dwell time of the racquet is increased, but these benefits are degraded by accompanying friction losses caused by strings moving radially across their cross-strings.

BRIEF SUMMARY OF THE INVENTION

It is an objective of this invention to provide for the design and construction of a racquet that gives a range of improved performance in terms of power and control and spin of a hit ball. In a preferred embodiment, improved performance can be provided by a transverse compliant structure in the racquet frame. The transverse direction is defined as the direction perpendicular to the plane of the strung surface. This transverse compliant structure, together with supportive structural features of the racquet frame, will herein be called the transverse compliant edge system. The transverse compliant edge system consists of a single or plurality of string supports, a matching and supporting racquet frame with provisions for large transverse string movement, and a plurality of transverse elastic supports. The transverse compliant edge system may be constructed to allow transverse elastic movement of the racquet's strings at any specific part of the racquet frame that is in addition to and independent of transverse elastic movement due to the elastic stretching of the string, the elastic bending of the racquet, or the transverse elastic movement of the string supported by the transverse compliant edge system at other parts of the racquet frame. The transverse compliant edge system may be constructed to inhibit accompanying radial movement of the string. The radial direction is defined as the direction along the supported string or, more generally, as any direction in the plane defined by the strung surface. The compliance of the transverse compliant edge system, and hence the amount of independent transverse movement resulting from the impact forces of a hit ball, may be determined and controlled by the configuration and the materials of the transverse compliant edge system and may be implemented during manufacture of the racquet.

Another objective of this invention is to provide a string support system that is stiff in the radial direction and therefore provides rigid radial support to the strings, which are elastic in the transverse direction to provide for and allow elastic transverse movement of the string at the locations of string support. This may be accomplished by providing a stiff string support rail that is rigidly supported in the radial direction by the racquet frame. The string support rail may be supported at a contact surface at the radially inner part of the string support rail in such a manner as to allow the string support rail to rotate about its contact surface, which therefore to act as a pivot. The rotation of the stiff string support rail provides a large transverse movement of the radially outer part of the string support rail that supports the string and therefore provides for a large transverse movement of the supported string while inhibiting accompanying radial movement. The rotation of the string support rail and the resulting transverse movement of the supported string is elastic in the sense that the string support rail returns to an equilibrium position when stresses from the impact forces of a hit ball cease to act on the string. This return is due to the action of the transverse elastic supports. The compliance of the elastic transverse supports and hence the time it takes for the string support rail to return to its equilibrium position is controlled by the configuration and the material used to make the transverse elastic supports and the elastic bending properties of the string support rail or a combination of both.

It is a further objective of this invention to provide a racquet frame that gives rigid radial support to the string support rails and also allows the elastic rotation of the string support rails and that also provides for and allows the transverse movement of the string while supporting the string that is usually under tension. Racquet frame embodiments are described herein that provide structural support and room for the transverse elastic structures that provide transverse elastic support to the string support rail.

It is a further objective of this invention to provide alternate transverse compliant edge system embodiments, other than the pivoting string support rail, which still provides for transverse elastic movement of the supported string while inhibiting, or preventing, accompanying radial movement of the supported strings that cause friction losses.

It is a further objective of this invention to provide a racquet frame construction and configuration that contains, and is part of, a transverse compliant edge system that provides for, and allows, elastic transverse movement of the supported string at the part of the racquet frame where the string is supported, while inhibiting radial string movement, and further providing for construction techniques and design that permits a racquet that is strong, durable, stiff and light enough to be playable and practical and having good balance and good weight distribution.

Another objective of the present invention is to provide an improved means for racquet construction.

Another objective of the present invention is to provide an improved means for increasing the size of the 'sweet spot' of a racquet.

Another objective of the present invention is to provide an improved means for controlling the racquet compliance.

Another objective of the present invention is to provide an improved means for controlling the transverse compliance.

Another objective of the present invention is to provide a means for adjusting the pivotal compliance of the string mount.

Another objective of the present invention is to provide an improved means for inhibiting radial string movement.

Another objective of the present invention is to provide an improved means for increasing dwell time.

Another objective of the present invention is to provide a means for improved hitting power.

Another objective of the present invention is to provide a means for improved ball control.

Another objective of the present invention is to provide a means for improved ball spin.

Another objective of the present invention is to provide an improved means for reducing friction in a racquet.

Another objective of the present invention is to provide an improved means for controlling radial stiffness of a string mount.

Another objective of the present invention is to provide an improved means for controlling the elastic transverse motion of a string mount.

Another objective of the present invention is to provide a means for elastic rotation of a string support system.

Another objective of the present invention is to provide an improved means for improving and controlling a racquet's strength.

Another objective of the present invention is to provide an improved means for improving a racquet's durability.

Another objective of the present invention is to provide an improved means for weight reduction of a racquet.

Another objective of the present invention is to provide a means for improving the balance of a racquet.

Another objective of the present invention is to provide a means for improved weight distribution of a racquet.

Another objective of the present invention is to provide a means for reducing vibration in a racquet.

Another objective of the present invention is to provide a means for matching string tension to characteristics of a racquet frame.

Another objective of the present invention is to provide a means for improved resiliency of a strung surface/racquet combination.

Another objective of the present invention is to provide a means for reducing friction in a strung surface/racquet combination.

Another objective of the present invention is to provide a means for increasing or enhancing string compliance in the lateral direction.

Another objective of the present invention is to provide a means for improved racquet stiffness.

Another objective of the present invention is to provide a means for retarding, reducing, or inhibiting string compliance in the radial direction.

Another objective of the present invention is to provide an improved tennis racquet.

Another objective of the present invention is to provide an improved squash racquet.

Another objective of the present invention is to provide an improved badminton racquet.

Another objective of the present invention is to provide an improved racquetball racquet.

Another objective of the present invention is to provide a racquet that has high power along with high ball control to allow the player to hit a ball and impart a high ball velocity (i.e. hit a fast ball) with small muscle effort, thus attaining higher ball placement accuracy in the opponent's court than would be possible if a high muscle effort would be required to hit the ball and impact that same high ball velocity.

The foregoing and other objects, features, and advantages of the principles and art taught by this invention, will be apparent from the following detailed description of this invention, as illustrated in the accompanying drawings.

BRIEF DESCRIPTION OF THE DRAWINGS

A better understanding of the present invention may be obtained from a consideration of the detailed description hereinafter taken in conjunction with the drawings, which are briefly described below.

FIG. 3 comprising

FIG. 4 comprising

FIG. 5 comprising

FIG. 6 comprising

FIG. 8 comprising

DETAILED DESCRIPTION OF THE PREFERRED EMBODIMENT

Figure 1:
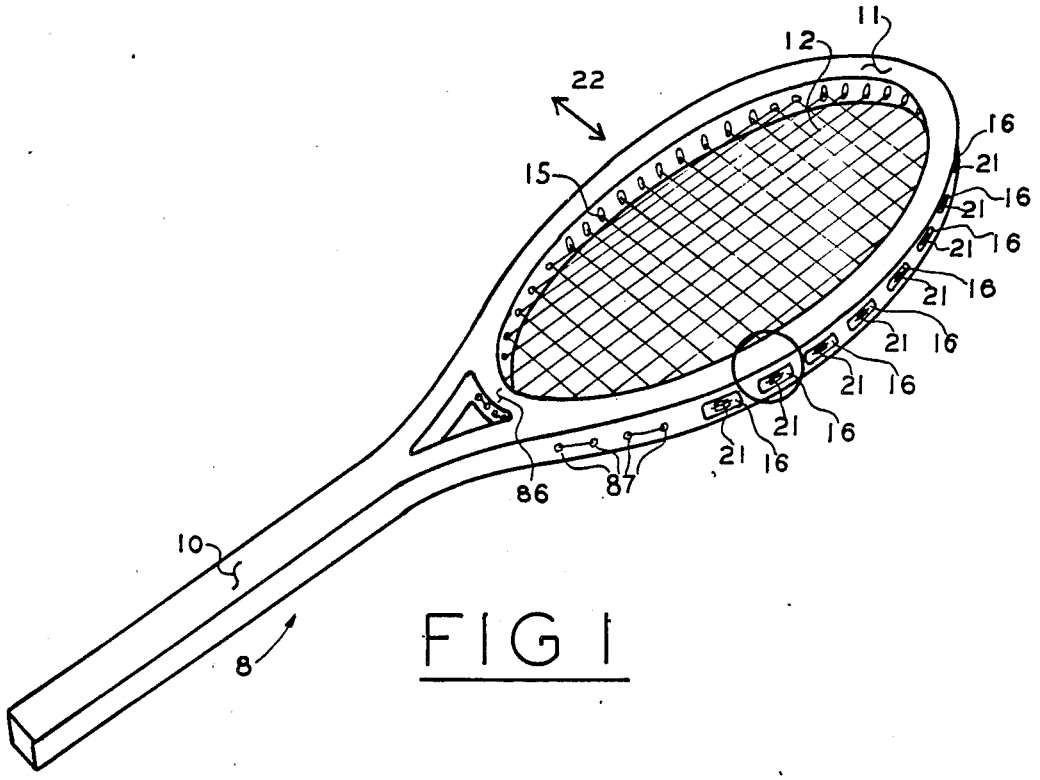
FIG. 1 shows a racquet having a transverse compliant edge arrangement in accordance with the present invention.

The system of the present invention can take any of a number of possible forms. Illustrative racquet embodiments are provided in the accompanying figures and are described hereinafter. Other non-racquet embodiments may also use the system of the present invention.

The rebound characteristics of a ball from a racquet having a hitting surface of crossed strings, are determined by such factors as the weight and elastic properties of the ball, the tension, resiliency, and friction coefficient of the string; the internal friction losses of the string, and the shape, weight, weight distribution, elastic properties, and internal friction losses of the racquet. Some of these factors may not be controllable by racquet design. For example, the physical properties of the ball have to be accepted as fixed by rules of the game and unpredictable wear and degradation due to use. Many constraints also impose certain restrictions and limits upon possible racquet designs. For example there is the constraint of a maximum weight of a racquet that a player can be expected to handle. Another example of a constraint is the maximum stiffness that can be attained from a racquet with a given weight. This constraint is governed by the physical properties of the racquet's materials and the construction techniques used.

Certain methods can be used for controlling and potentially improving playing characteristics of a racquet. Such method include altering the elastic characteristics of the string, changing the string tension, changing the racquet's weight, weight distribution, size and shape, changing the transverse or torsional stiffness of parts of the racquet, or combinations of these changes. Such changes, at least to some degree, can be provided as a function of construction designs, choice of materials and construction processes. Often, an improvement in a given racquet characteristic, i.e. the maximum attainable ball rebound response, which is called 'power', is gained at the expense of reducing some other desireable characteristic, such as the degree of control of the ball's rebound direction. various desired characteristics such as power, control, lack of vibration, low weight and rotational inertia may be incompatable; making it difficult to optimize a racquet. Therefore, trade-offs and compromises in design and construction of a racquet and in the choice of materials and construction processes may be used.

Physical properties of a racquet and their effect on the racquet's playing characteristics will now be discussed.

The rebound response of a hit ball to a racquet can be calculated using physical equations that describe the dynamic behaviour of the ball, the strung surface, and the racquet. Analysis shows that the rebound response to a ball from a racquet can be closely calculated given the ball's weight and rebound efficiency; the racquet's mass, mass-distribution, losses, stiffness; and dwell time. Dwell time is the time the ball is in contact with the strings of the racquet when it is being hit. Dwell time may be determined by the physical properties and friction losses of the strings, the racquet, and the ball. Friction losses can be both external and internal to the strings, the racquet, and the ball. Dwell-time is a measure that allows combining many diverse and difficult to measure characteristics into a single observable physical property that directly enters into the rebound equations. Dwell-time has the further advantage of being a measurable property that is an important and sensitive parameter in the rebound equations which combines characteristics of the ball, the strings and the racquet. Some general observations of dwell-time are that increased resiliency in the strings or the racquet increases the ball's dwell-time while a stiffer racquet, or stiffer strings, or higher string tension tend to decrease dwell-time. These observations are accurate for dwell times up to 10 milliseconds. This approximate limit results from the oscillatory nature of the solution to the rebound equations. Ball-racquet dynamics permits optimization of a racquet's rebound response by matching the dwell-time as a function of the ball's impact point on the strings to such racquet characteristics as weight, weight distribution, lateral stiffness, and stiffness distribution. Such a matching may involve increasing dwell-time from that implicit in a conventional racquet with stiff string mounts.

Various parameters and the relative advantages and disadvantages thereof will now be discussed.

Racquet weight is an important design parameter. Greater weight can be advantageous because it provides greater power due to an increase in racquet ball momentum ratio. However, greater weight can be disadvantageous because it increases a racquet's inertia, which reduces quickness and increases arm fatigue. Reduced weight can be advantageous because it provides quicker response and less arm fatigue. However, reduced weight can be disadvantageous because it provides reduced power due to a decrease in racquet/ball momentum ratio.

Weight on a racquet periphery is an important design parameter. Greater weight on the periphery can be advantageous because it provides greater power and a wider 'sweet spot' due to increased rotary inertia. However, greater weight on the periphery can be disadvantageous because it reduces a racquet's quickness, caused by a higher rotational inertia, and because it increases arm fatigue.

Resiliency of the strings is an important design parameter. Greater string resiliency can be advantageous because it provides greater power and control due to increased dwell-time. However, greater string resiliency can be disadvantageous because causes reduced power due to greater string friction losses and because it causes greater string wear and string weakening due to greater string friction, and elastic extension.

Resiliency of the racquet is an important design parameter. Greater racquet resiliency can be advantageous because it provides greater power and control due to increased dwell-time and because it reduces transmission of impact shock and vibration. However, greater racquet resiliency can be disadvantageous because it reduces power and control due to flex-losses and racquet deformation. Reduced racquet resiliency can be advantageous because it provides greater power due to lower racquet losses and because it provides greater control due to reduced racquet deformation. However, reduced racquet resiliency can be disadvantageous because it reduces power, control and ball spin due to reduced dwell-time and because it increases transmission of impact shock and vibration. The above discussion of tradeoffs is exemplary of compromises between apparently conflicting and seemingly contradictory results of parametric changes. For example, although increasing dwell-time may have beneficial effects on a racquet's playing performance, the accompanying increases in racquet and string losses can mitigate the benefits.

In accordance with the present invention, a means and method is provided to control and extend a racquet's dwell-time without increasing frictional losses. This permits design for the highest power for a given racquet weight. The high power can be further increased by independently adjusting the dwell-time; usually by extending the dwell-time. Additional benefits of extended dwell-time of a higher power racquet is that improved control and higher ball spin are achievable over an identical racquet for which the dwell time is not extended. Improved control is due to the longer time that the racquet's string surface has to impact a desired ball rebound direction and also the longer time that the player has to make final directional adjustments. Improved ball spin is due to the longer time that the racquet's strings are in contact with the ball and can thus act for a longer time to induce more ball rotation.

The arrangement of providing a separate means and method for the controlled extension of a ball's dwell time allows simultaneous optimization of several important racquet performance characteristics without introducing losses that detract from the improvements.

In the development of the system of the present invention, several alternate embodiments were configured using radially compliant structures. However, the system of the present invention has important advantages thereover. The radially compliant structure, because of its elastic properties that momentarily stores part of the ball's impact energy, will tend to increase the ball's dwell time. However, the radially compliant nature of the structure introduces additional losses that mitigates the benefit of extended dwell-time. The introduced additional losses results from the radially compliant structure allowing radial movement of the strings that absorb the ball's impact force. This radial movement moves the supported strings across its cross-strings. Since all the strings are kept in high tension, there are high friction losses due to the supported strings sliding across their cross-strings. The high friction losses for crossing strings that are under high tension are illustrated by a common occurrence. If a single string in a racquet breaks, although the string is connected to neighboring strings along the same direction through the racquet frame mounting system, the high friction keeps the neighboring strings under tension. often for considerable time. It should be noted that even the radially compliant structures which also allow elastic transverse movement will retain the high friction losses due to the radial movement of the supported strings.

Several experimental racquets built and tested in the course of developing the system of the present invention contained radially compliant string mounts. The tests results showed that the radially compliant mounts resulted, as predicted, in lower power racquets having a remarkably 'mushy' feel. This 'mushy' feel was caused by the combination of friction losses in the strings combined with a long dwell-time. These racquets had an unacceptably lower power and lack of 'ball feel' They could be improved by making the radial strings so stiff so they allowed very little radial movement and thus would not function in their intended dwell-time extending role. These experimental racquets demonstrated the need to control and extend a racquet's dwell-time independent of the racquet's string configuration without introducing new external or internal friction losses which reduce or cancel the improvements of the racquet playing characteristics gained from increased dwell time.

The transverse compliant edge system of the present invention achieves the goal of controlling and extending dwell-time independent of the dwell-time inherent in the racquet and string configuration and does not introduce significant new losses.

In a preferred embodiment, the string is mounted on a structure located at the racquet frame that can pivot, roll, slide or otherwise move in the transverse direction while inhibiting radial movement. This transverse movement is acted upon and controlled by elastic structures that maintain an equilibrium position for the structural part that directly supports the string, called the string support. However, the string support allows transverse elastic movement of the string through elastic deformation of the elastic structures causec by impact forces of a hit ball. This elastic transverse movement is independent of any additional movement of the racquet or strings. It acts to extend the ball's dwell-time on the racquet by momentarily storing the ball's impact energy. This dwell-time extension can significantly improve racquet playing characteristics. It can be determined and controlled by the configuration and materials of the string mount construction and the elastic structures. The string mount and elastic structures, including all supportive features of the racquet frame, are herein called the transverse compliant edge system.

In a general sense, the invention described in this disclosure provides a 'power matching system' for a racquet that allows the independent matching of dynamic properties of a hit ball to a racquet. This independent matching yields a racquet that provides for a wide range of beneficial physical characteristics while avoiding accompanying drawbacks. Independent matching allows the racquet and strung surface mechanical properties and dynamics to interact with a hit ball to optimize rebound energy and directional control of the rebounding ball. An important property of power matching is inhibition of friction losses in the racquet and in the strung surface when stressed and deformed by impact forces of the hit ball. This is accomplished by inhibiting separate relative motions of strings and cross-strings.

A detailed description will now be provided on the transverse compliant edge system that allows elastic transverse movement of the string while inhibiting accompanying radial movement.

Figure 2:
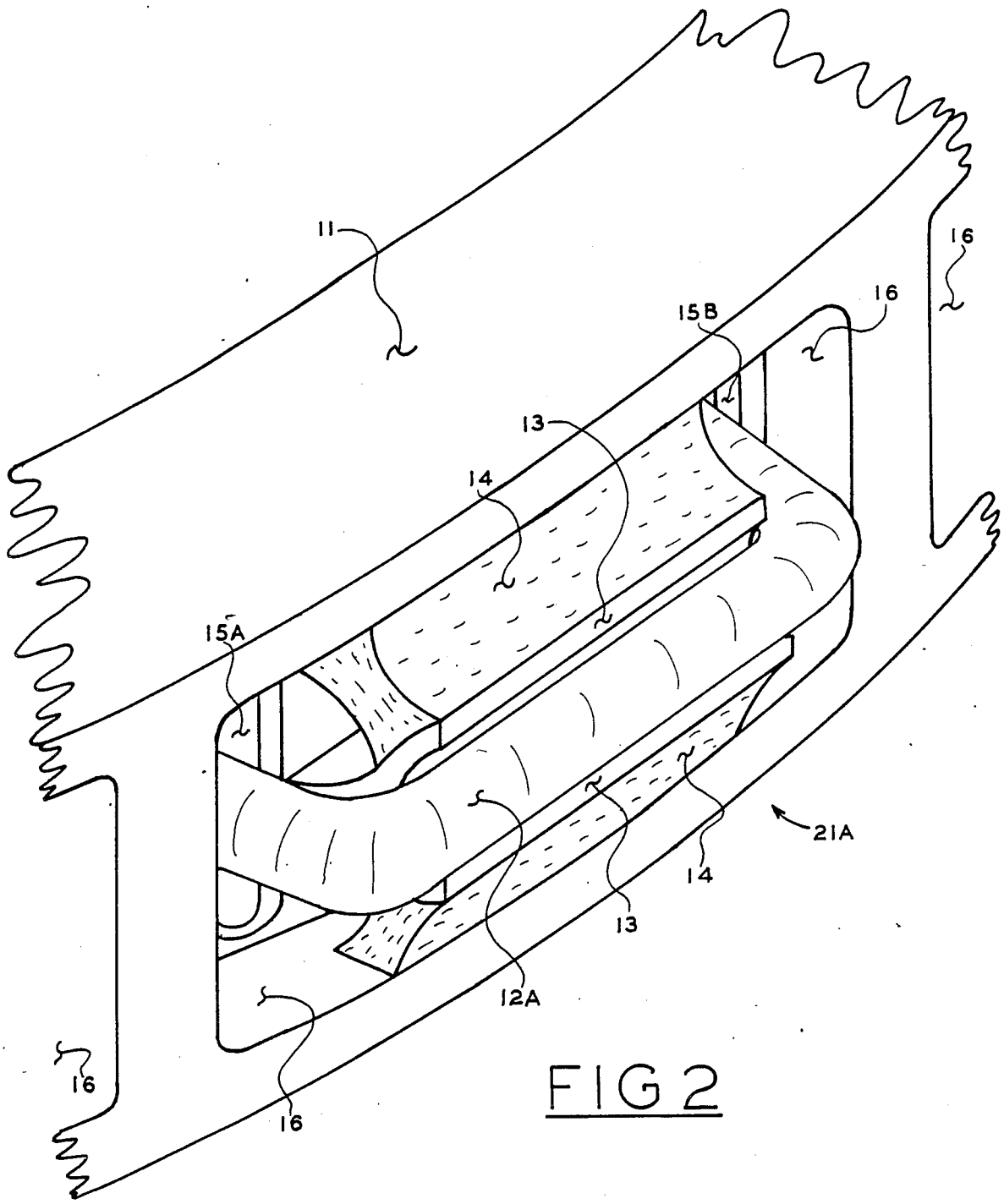
FIG. 2 shows a perspective view of a transverse compliant edge arrangement in accordance with the present invention.

A compliant edge arrangement in accordance with the present invention will now be discussed with reference to FIGS. 1 to 3. FIG. 1 shows a racquet 8 having a handle 10, frame 11, and strings 12. A transverse compliant edge arrangement is provided around the periphery of frame 11 in separate outer cavities 16 or in a continuous outer channel 16 that is located around the radially outer periphery of the racquet frame 11. Such cavities may be supporting strings 12, having holes 15 and string supports 21. Some of the holes 87 in frame 11 may not use the transverse compliant edge arrangement. A preferred embodiment of transverse compliant edge arrangement is composed of a plurality of string supports 21 characterized by string support rail 13 contained in outer cavities 16 shown in a perspective view in FIG. 2 and in a cross-section view in FIG. 3. Other embodiments thereof can be provided based upon the teachings herein.

Figure 3A:
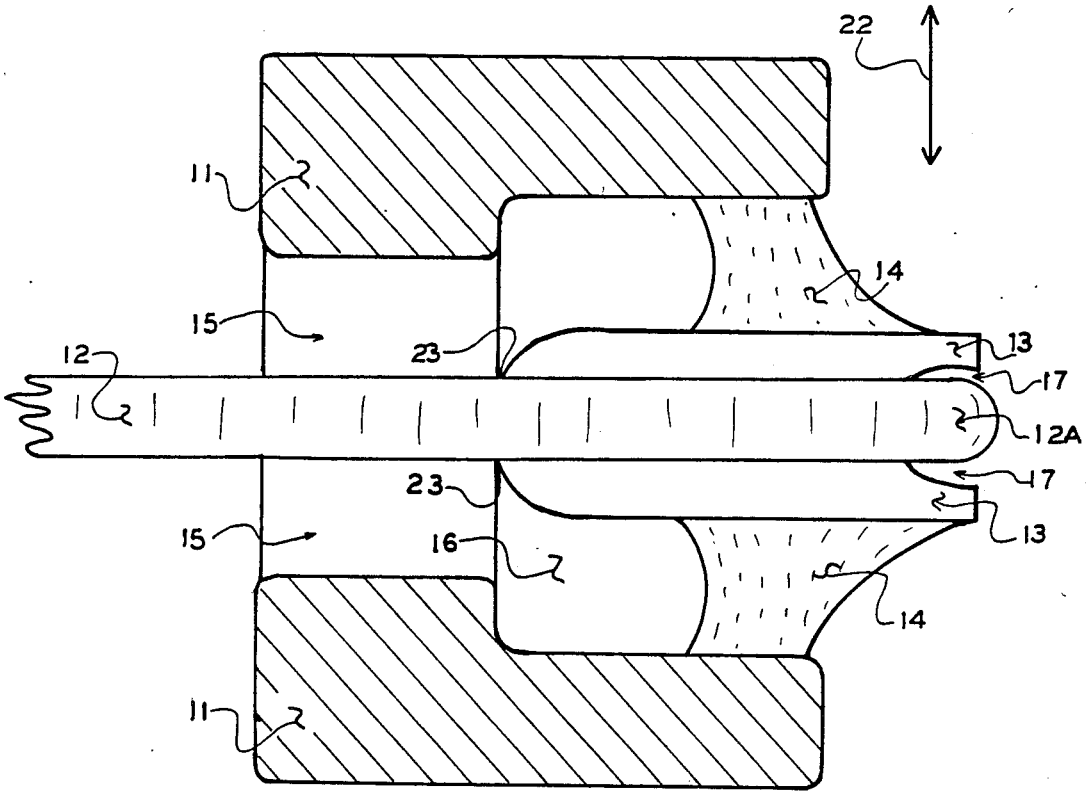
FIGS. 3A to 3C shows sections of a transverse compliant edge arrangement in accordance with the present invention.

A single loop of string and the compliant edge structure having an outer cavity arrangement will now be discussed with reference to FIG. 2. A loop 12A of string 12 enters outer cavity 16 through hole 15A and exits through hole 15B. This represents a single loop 12A of string 12 which has many loops around the periphery of frame 11. In one embodiment, each pair of adjacent holes 15 may support and facilitate a loop of string. Holes 15 illustrated by holes 15A and 15B may be elongated in the transverse direction to facilitate transverse motion of string 12. Alternately, holes 15 may be enlarged or otherwise configured to provide clearance for transverse compliant motion of string 21. String 12A is supported by string support rail 13. As shown in FIG. 3A; string support rail 13 may have a contact surface 23, that acts as a pivot 23, against frame 11 and may have a string groove 17. String 12A can ride in the string groove 17 for stability. Other stability arrangements such as a ridge or a shoulder may be used in place of string groove 17. Pivot 23 permits string support rail 13 and string 12A to move transversely 22 by pivotal motion about pivot 23. Other transverse motion arrangements may be used in place of pivot 23 such as a slide, a guide, and a roller. String support rail 13 therefore provides rididity on the radial direction (in the plane of strings 12) and provides motion in the transverse direction 22 (perpendicular to the plane of strings 12).

Compliant structure 14 may be used for supporting string support rail 13 in the transverse direction 22 and for centering string support rail 13 in outer channel 16. Outer channel 16 may be formed in frame 11 for housing string supports 21. Outer channel 16 may be molded, grooved cut, or otherwise formed in frame 11 and may be formed in various ways exemplified by separate cavities or a continuous channel. Compliant structure 14 may be springs, elastic materials, metal, rubber, plastic or other compliant arrangements.

String support rail 13 may be maintained in an equilibrium position in the center of outer channel 16, which may be formed at the outward edge of racquet frame 11. The outer channel 16 may be constructed to be a series of separate cavities 16 as shown in FIG. 1, or may be constructed to be a continuous channel along the periphery of the outward edge of racquet frame 11. Space may be provided between the walls of outer channel 16 and string support rail 13 to provide room for compliant structure 14 and for transverse movement of string support rail 13. The space can be fully or partially filled with elastic structures 14 which may transversely support and center string support rail 13 and which may provide transverse elastic movement of string support rail 13 and string 12 being supported through elastic deformation. Transverse movement may be caused by the impact force of a hit ball.

FIG. 3A shows a cross section of the racquet frame 11 taken through transverse compliant edge system. String support rail 13 may be firmly supported to prevent transverse or peripheral motion, by pivot 23 at the radially inward part of outer channel 16. String support rail 13 contains a radially outward string groove 17 for holding string 12. String support rail 13 can rotate or pivot about its radially inward part 23, which is supported by racquet frame 11. Thus, string support rail 13 can provide transverse motion of string groove 17 together with string 12 that it holds. String support rail 13 can rotate about its radially inward part supported by frame 11, providing transverse movement of groove 17 and thus string 12 being supported thereby. Compliant structure 14 provides transverse support for string support rail 13 to control transverse movement of String support rail 13. It stores impact energy from a hit ball for a short time, thereby increasing dwell time of a ball on the racquet's strings. Elongated string holes 15 allow the resulting transverse movement 22 of string 12 and reduces friction losses due to string 12 rubbing on parts of racquet frame 11 and due to string 12 rubbing on other parts of string 12.

Figure 3B:
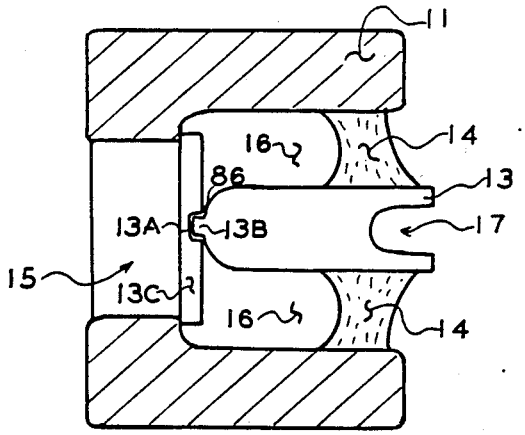
Figure 3C:
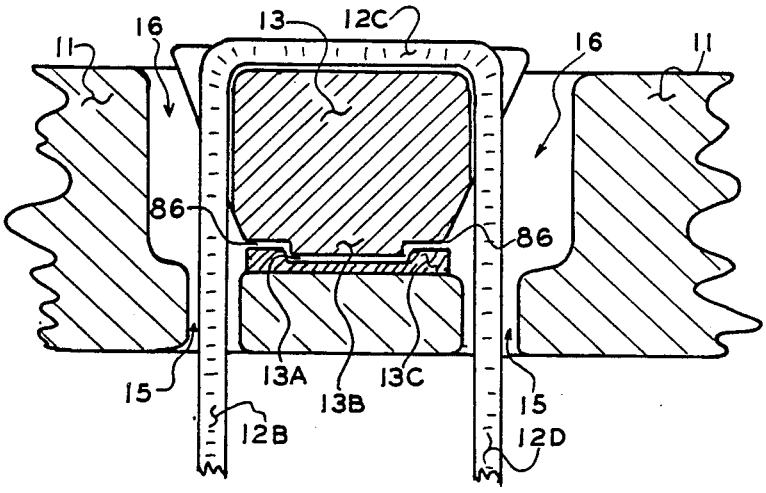

FIG. 3B shows a cross-sectional view and FIG. 3C shows a side sectional view of the radially inwards part of string support rail 13. Protruding key 13A fits in a mathcing hole 13B in racquet frame 11. Key 13A inhibits peripheral motion of string support rail 13 and inhibits transverse motion of the inwards part of string support rail 13 while permitting desired rotational motion of string support rail 13 about its radially inwards contact surface 23 that acts as a pivot 23. Matching hole 13B and contact surface 23 of racquet frame 11 may be implemented directly at the radially inwards part of racquet frame 11 that forms the bottom of outer channel 16. Alternately, they may be implemented by bonding contact plane 13C with a matching hole 13A onto the bottom of outer channel 16. Contact plate 13C may be constructed of a hard material such as a metal, plastic, or mineral. It has the advantage of distributing the radial forces caused by the high tension of strings 12, and transmitted through string support rail 13, over a large part of racquet frame 11. Contact plate 13C an be made extremely hard and therefore can provide a very low friction, non-deforming, and non-wearing contact surface 23 for string support rail 13.

Impact forces of a hit ball are transferred through string 12 to string support rail 13, with the transferred forces having both radial and transverse force components. Radial force components are transferred through string support rail 13 to frame 11, which provides rigid radial support. The radial rigidity and strength of frame 11 inhibits radial components of the imapct force from causing radial movement of string support rail 13 and thus string 12. Transverse components of transferred impact forces are transferred to compliant structures 14 since string support rail 13 can rotate about its contact surface 23 in a direction transverse to the plane of the racquet frame 11. Compliant structure 14 may be attached to frame 11 at the inside walls of outer channel 16. Compliant structure 14 may elastically compress and elongate to store energy from impact forces of a hit ball. String support rail 13 and string 12 can move in a transverse direction parallel to and along the same direction as the path of the incoming ball. The magnitude of the impact force from a hit ball determines the magnitude of the transverse component of force that is transmitted to compliant structure 14. The magnitude of the transverse force on compliant structure 14 causes and is directly proportional to the elastic compression of compliant structure 14 on one side of string support rail 13, and elastic stretching of compliant structure 14 on the other side of string support rail 13, the side of the strung surface of the racquet on which the ball is being hit, as is shown in FIG. 4D. The result is that string support rail 13 and string 12 which it supports move in transverse direction 22 a distance that is directly proportional to the magnitude of the transverse component of the ball impact force.

The transverse force transferred to a particular part of transverse compliant edge system located at a specific location on the periphery of frame 11 is inversely related to the distance of a ball's point of impact to that specific location on frame 11. Thus, the parts of the transverse compliant edge system that are closest to the point of impact will show greater transverse string movement than the parts of the transverse compliant edge system that are further away from the point of impact. This effect is caused by greater stiffness of shorter string segments on the sides closest to the impact point, which will transfer a greater part of the transverse impact forces, and because of the geometry of string deflection and because of the fewer cross-strings between the impact point and the closer part of frame 11 to absorb impact forces.

A ball hit at or near the center of the racquet's hitting surface bounded by the loop formed by the racquet frame 11 transmits its impact forces evenly and symmetrically to compliant structures 14 distributed around periphery of racquet frame 11. All compliant structures 14 thus share the transmitted impact forces, fairly evenly causing small and roughly equal transverse movements of all string support rails 13 and the strings 12 that they support.

An off center hit imparts higher forces to the transverse compliant edge system in the closer parts of frame 11 than to the parts of the transversed compliant edge system farther away. Therefore, string support rails 13 in closest parts of the transverse compliant edge system move in a transverse direction by a larger amount that string support rails 13 in further parts of the transverse compliant edge system. This larger transverse movement of string support rails 13 on the short side of a ball's impact point enhances ball control and power by the compensation and reduction of detrimental effects of this high stiffness of short string segments on the short side of the ball's impact point.

An important advantage of this invention is that transverse compliant edge system momentarily stores part of the energy of impact forces of a hit ball in the compliant structures 14 and then returns energy to the rebounding ball through string support rail 13 and string 12. Energy storage increases dwell time of a ball on strings 12 by an amount that is related to compliance of transverse compliant edge system; and the combined mass of the ball, strings 12, and the moving parts of the transverse compliant edge system; and the losses in compliant edge system. Analysis, supported by experimentation, shows that dwell time of tennis racquets and racquet ball racquets can be increased by 0.01 to 10.0 milliseconds using the transverse compliant edge of the present invention. Dwell-time increase can be predicted, determined, and controlled by stiffness of compliant structures 14. Thus, the present invention permits the dwell time to be designed to optimize physical characteristics of a racquet. The resulting racquet will have substantially higher power together with better ball control.

It is important that gains from increased dwell time not be negated by additional friction losses that reduce a ball's rebounding power of a ball. Transverse elastic motion provided in accordance with the present invention increases dwell-time while inhibiting radial motion of the strings and resulting frictional losses.

The features of the transverse compliant arrangement of the present invention will now be discussed with an illustration of string motion and compared to a radial compliant arrangement. Both the transverse compliant arrangement and the radial compliant arrangement in the region circled in FIG. 1 will be considered, with corresponding illustrations labeled 4A to 4D for the tranverse case and 5A to 5D for the radial case and shown side by side for comparison therebetween.

Figure 5A:
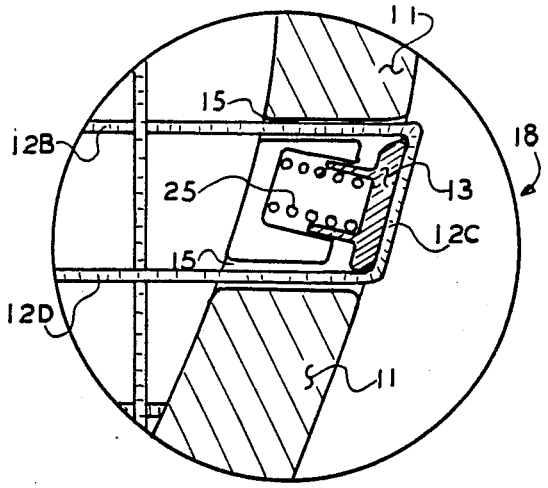
FIGS. 5A to 5D illustrates operation of a radial compliant edge arrangement.
Figure 4A:
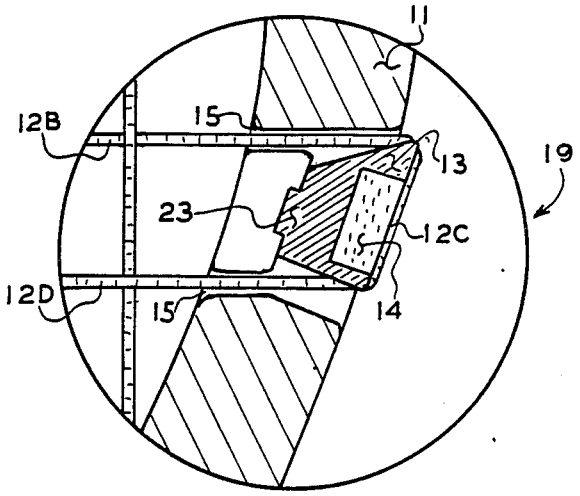
FIGS. 4A to 4D illustrates operation of the transverse compliant edge arrangement in accordance with FIG. 2.
Figure 5B:
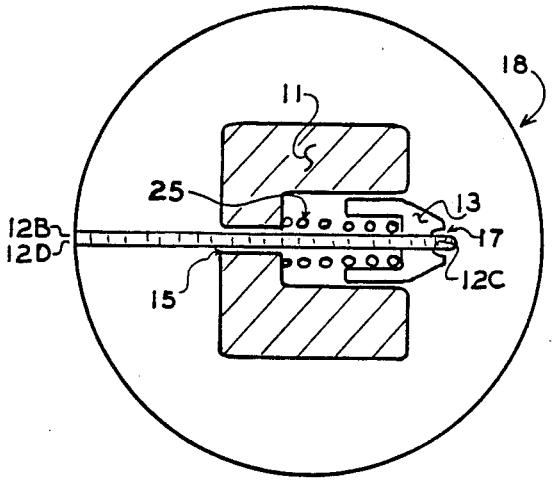
Figure 4B:
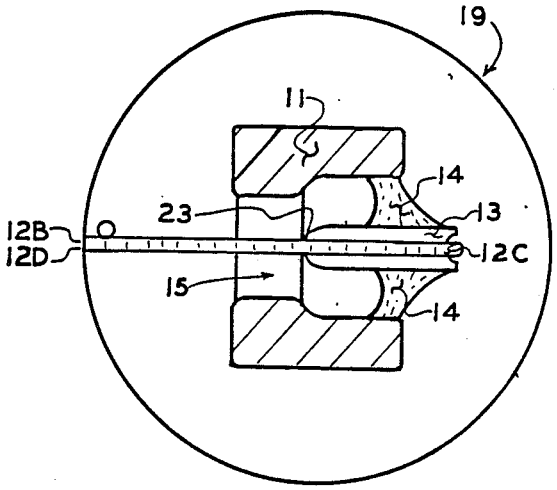

FIGS. 4A and 5A show transverse compliant and radial compliant arrangements, respectively, in the plane of frame 11 to illustrate string support 18 and 19. String support 18 and 19 include string support rail 13 and transverse compliance 14 or radial support string 25. String 12B enters string support 18 and 19 and loops around 180° 12c to return as string 12D. String loop 12C is supported by string support 18 and 19. Similarly, FIGS. 4B and 5B shows transverse compliant and radial compliant arrangement, respectively; but in a plane perpendicular to the plane of frame 11 and sectioning frame 11 (cross hatched) through string support 18 and 19. String 12B enters string support 18 and 19 and loops around 90° 12C to traverse out of the plane of the page (as shown) and loops back into the plane of the page as string 12D (not shown in FIGS. 4B and 5B). String loop 12C is supported by string support 18 and 19. The transverse compliant arrangement shown in FIGS. 4A and 4B permits string 12B, 12C, and 12D to move transversely or perpendicular to the plane of the racquet by the string support pivoting about pivot point 23; as discussed with reference to FIG. 3 above. Radial motion is minimized by the stiffness of string support rail 13 in the radial direction. The radial compliant arrangement shown in FIGS. 5A and 5B permits string 12B, 12C, and 12D to move radially in the plane of the racquet by compressing radial support spring 25.

Figure 4C:
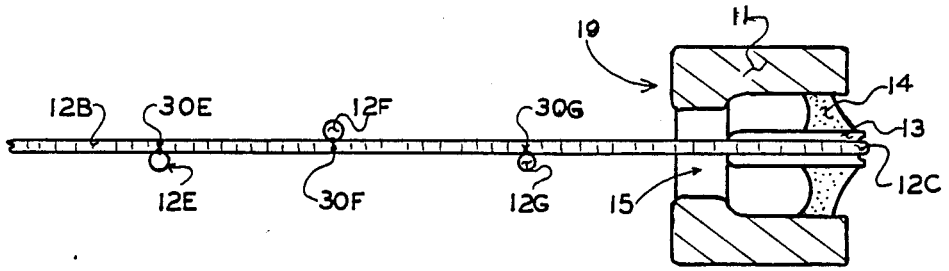
Figure 4D:
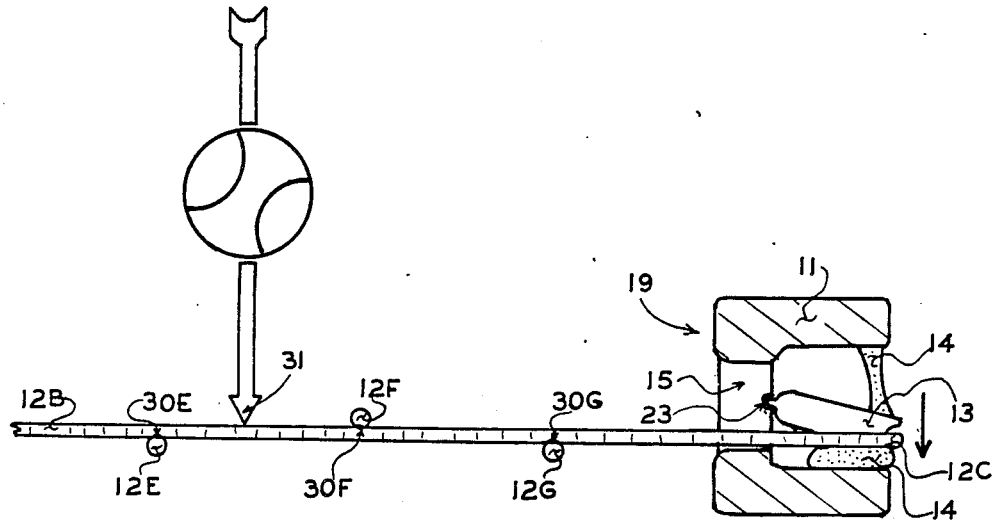
Figure 5C:
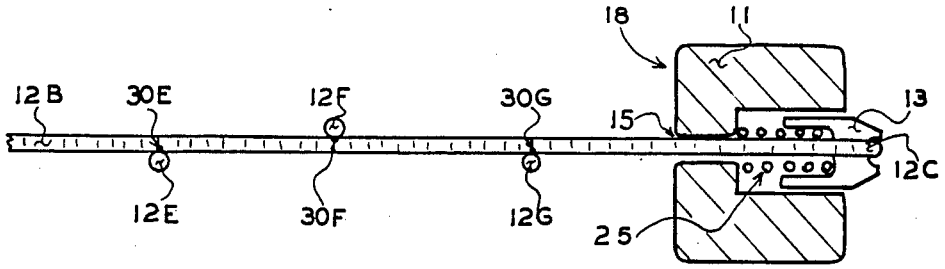
Figure 5D:
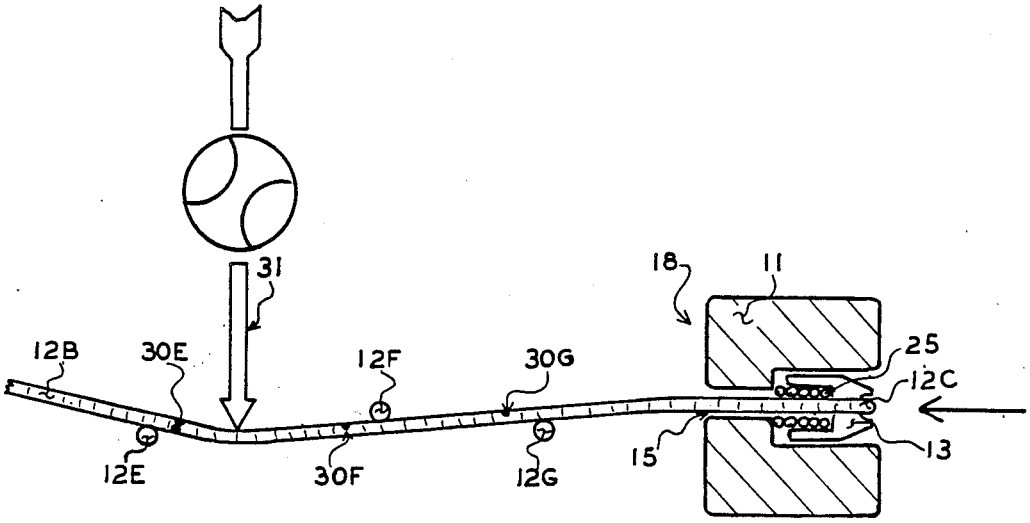

FIGS. 4C and 4D illustrate the effects of a hit ball on string 12B supported with a transverse compliant arrangement 19 and FIGS. 5C and 5D illustrate the effects of hit ball on string 12B supported with a radial compliant arrangement 18. FIGS. 4C, 4D, 5C, and 5D show string support 18 and 19 in a plane perpendicular to the plane of frame 11 and sectioning frame 11 (cross-hatched) through string support 18 and 19; as discussed above with reference to FIGS. 4B and 5B. String 12B enters string support 18 and 19 and loops around 90°

12C to traverse out of the plane of the page (as shown) and loops back into the plane of the page as string 12D (not shown in FIGS. 4C, 4D, 5C, and 5D). Three cross strings 12E, 12F, and 12G are shown crossing string 12B, perpendicular to string 12B and to the plane of the page. FIGS. 4C and 5C show strings 12B and 12E to 12G in a quiescent condition when the strung surface does not contact a ball. Positions on string 12B contacted by strings 12E, 12F, and 12G in the quiescent condition are shown as positions 30E, 30F, and 30G respectively (the quiescent contact positions). FIGS. 4D and 5D show strings 12B and 12E to 12G in a stressed condition, caused by the impact force of ball 31. Quiescent contact positions 30E, 30F, and 30G are shown in FIGS. 4D and 5D, as affected by the stressed condition. Also, compression of radial support spring 25 and pivoting of string support 13 about pivot 13A and 13B are shown in FIGS. 5D and 4D respectively as affected by the stressed condition. FIG. 4D shows that the quiescent contact positions 30E, 30F, and 30G remain approximately the contact positions in the stressed condition for the transverse compliant arrangement (FIG. 4D) which inhibits relative radial motion between string 12B and cross strings 12E, 12F, and 12G. This in turn inhibits friction losses. FIG. 5B shows that the quiescent contact positions 30E, 30F, and 30G change position because of compression of radial support springs 25 in the stressed condition for the radial compliant arrangement (FIG. 5D) with accompanying increased relative motion between string 12B and cross strings 12E, 12F, and 12G. This increases friction losses.

The stressed condition due to the impact force of a ball will now be discussed. As shown in FIG. 5D, location of an impact force of a ball on the supported string 12B is illustrated with arrow 31. As supported string 12B is pushed downward by the force of the ball, radial compliance 18 allows string 12B to move inwards toward the center of the frame 11 in the radial direction by compressing radial support spring 25. At the time of maximum impact force, supported string 12B has moved relative to its cross-strings 12E, 12F and 12G; shown by the movement of the quiescent positions 30E, 30F, and 30G. Supported string 12B has rubbed across the cross-strings as it moved radially. Strings 12B, 12E, 12F and 12G are under high tension forcing close contact between cross-strings. Therefore, this rubbing causes high friction losses. The total friction losses are the sum of all of the friction losses of all of the affected strings 12. FIG. 4D shows the transverse compliant edge system affected by the same impact force 31 discussed with reference to FIG. 5D above. The transverse mount has moved transversely along the direction of motion of the ball by the rotation of string support rail 13 about its pivot 23. Since radial movement of the string is inhibited by stiffness of string support rail 13, relative movement between strings 12B, 12D, 12F and 12G is also inhibited. In this case radial movement is small; being derived from stretching of string 12B, from movement of frame 11, and from a radial component of the rotation and compression in parts of transverse string mount 19. These factors of radial movement can be made very small. Therefore, friction losses caused by radial movement of string 12B can also be made very small. Thus, the benefits of increased dwell time can be realized. Other important benefits of this arrangement include (a) the 'sweet spot' (an area of high ball rebound response) is increased and (b) the angular deviation of a rebounding off-center bit ball (from a direction normal to the racquet face) is reduced.

Figure 6A:
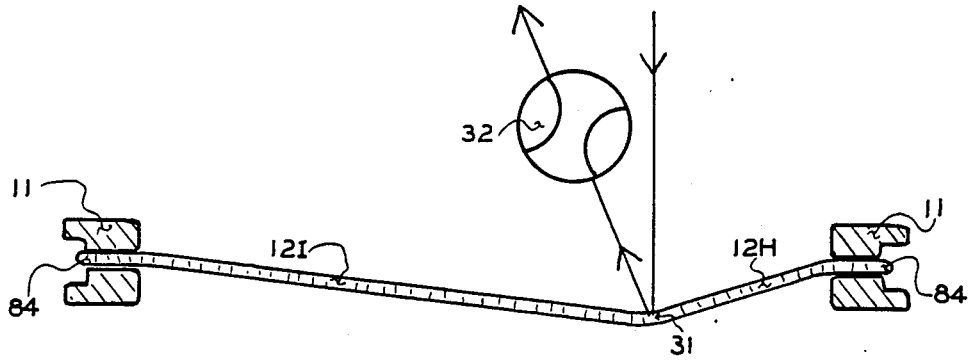
FIGS. 6A to 6E illustrates ball rebound advantages of the present invention.
Figure 6B:
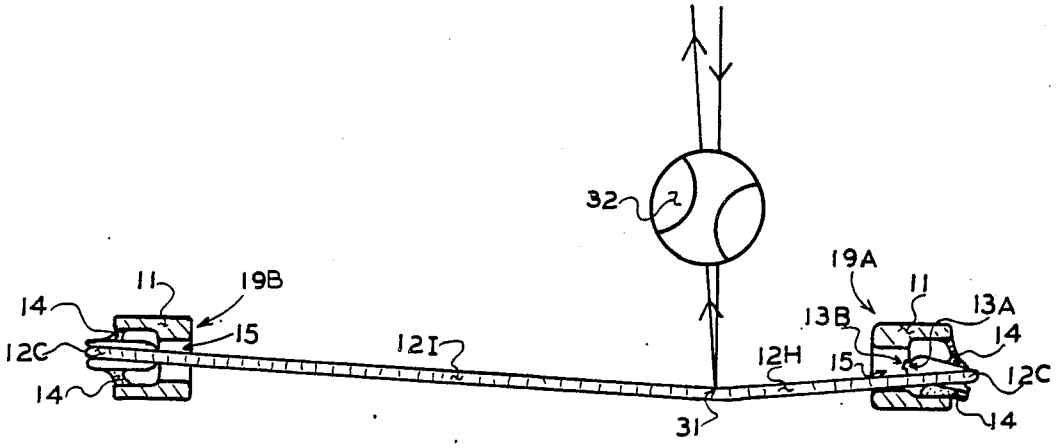

The effects of an off-center ball will now be discussed with reference to FIGS. 6A and 6B. An off-center ball 32 rebounding from string 21 of a conventional racquet, where string 12I is directly supported 84 by racquet frame 11, is shown in FIG. 6A. String segment 12H on the short side of the point 31 is stiffer than the string segment 12I on the long side of the impact point 31. Therefore, force exerted on ball 32 will include a radially inward component causing ball 32 to bounce inwards. An off-center ball 32 rebounding from string 12 of a racquet having a transverse compliant edge system of the present invention is shown in FIG. 6B. The large transverse movement of the transverse string mount 19A nearest the impact point causes the support of the shorter and therefore stiffer string segments 12H along the direction of the incoming ball to move in the transverse direction along the direction of the incoming ball. This reduces the angular deviation effects on the ball of the stiffer string segment 12H on the short side. Thus, the inward angular deviation of the rebounding ball is reduced. The result is a racquet with a large 'sweet spot' and good angular control for off-center hit balls.

Another feature of the present invention is the use of energy storage. The dynamic theory of the racquet/-strung surface/ball interaction shows that it may be beneficial, in terms of power and control of the hit ball, to control and extend the ball's dwell-time on the racquet. This may be accomplished by storing part of the energy from impact forces of a hit ball in the racquet for a short time. The present invention provides a means and methods to elastically store impact energy of a hit ball and thus to beneficially extend dwell-time of the hit ball with reduced losses that could reduce or reverse benefits of extended dwell-time. These benefits will now be discussed with reference to FIG. 6C to 6E.

Figure 6C:
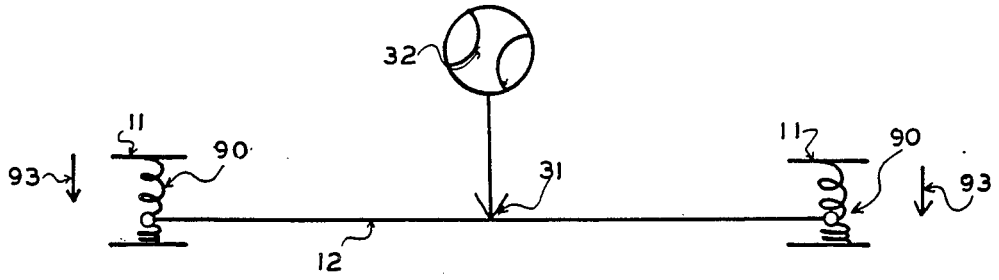

FIG. 6C is a schematic representation of a cross-section of frame 11 of a racquet having transverse compliant edge system 90. The impact force of the hit ball 32 is shown by arrow 31. Impact force 31 moves strings 12 and therefore transmits energy into the strung surface, formed by strings 12, that is supported by transverse compliant edge system 90. This energy is partially stored in transverse compliant edge system 90, thus extending dwell-time. Transverse compliant edge system 90 allows supported string 12 to move in transverse direction 93, but inhibits radial motion of supported string 12. Thus, the strung surface tends to move in transverse direction 93 with little transverse deformation. Alternately stated, the strung surface tends to move as a plane transversely in response to the impact forces of hit ball 32. This may be characterized as transverse planar compliance. Since compliant edge system 90 can be constructed to have very small elastic losses, the dwell-time can be extended and detrimental losses can be minimized or eliminated.

The transverse compliant edge system of the present invention may be considered to be a transversely compliant plane, where the interwoven string may be considered to be a single compliant hitting surface. This arrangement provides a means for mounting the hitting surface to the racquet frame in a form that permits the hitting surface to move in unison in response to transverse forces of a hit ball. This maintains the hitting surface in a planar surface form more than hitting surfaces using a rigid or a radially compliant mounts.

Figure 6D:
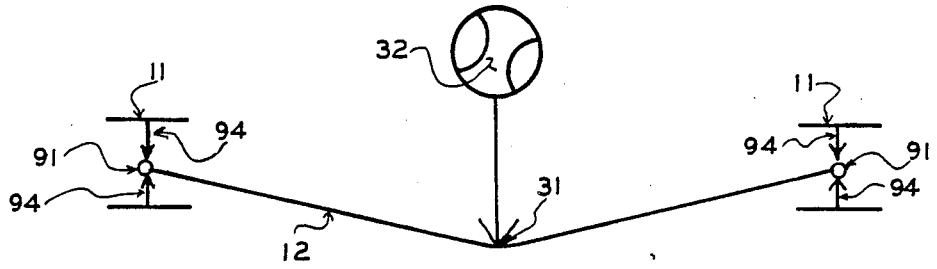

FIG. 6D is a schematic representation of a cross-section of frame 11 with a conventional hard mount 91. The impact force of hit ball 32 is indicated by arrow 31. Supported string 12 is inhibited from moving transversely and radially, as is indicated by small arrows 94. The impact energy is absorbed by the strung surface and racquet frame 11. The rigidity of racquet frame 11 and the constrains imposed by hard mount 91 causes hit ball 32 to stretch strings 12. Since string 12 at its hard mount support 91 cannot move in the transverse direction, the stretched strings form a transversely deformed strung surface. The transverse deformation of the strung surface generates external and internal friction losses. Internal losses in the form of friction and heat are caused by relative motion of material molecules of string 12 as it stretches. External losses are caused by the different motions and elongations of strings 12 that form the transversely deformed strung surface, where strings 12 rub across and along each other. These deformation losses are avoided in the relatively co-planar motion of transverse compliant edge system 90, as discussed with reference to FIG. 6D.

Figure 6E:
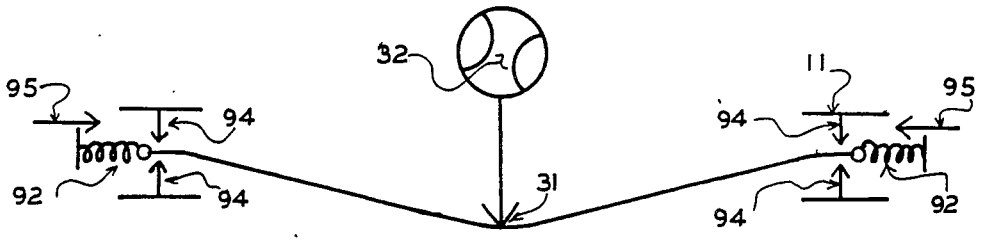

FIG. 6E is a schematic representation of the cross-section of a frame 11 with radial string mount system 92. Radial motion 95 of supported string 12 is permitted. Strings 12 will move radially in response to impact force 31 of hit ball 32. Radial movement 95 will be different for different strings 12 and will cause transverse deformation of the strung surface. This transverse deformation causes significant deformation losses, similar to those discussed with reference to FIG. 6D; which can reduce, negate, or even reverse any benefits gained from the radially compliant structure.

Therefore, the transverse compliant structure discussed with reference to FIG. 6C provides significant advantages over the hard mount structure discussed with reference to FIG. 6D and the radially compliant structure discussed with reference to FIG. 6E.

Figure 7A:
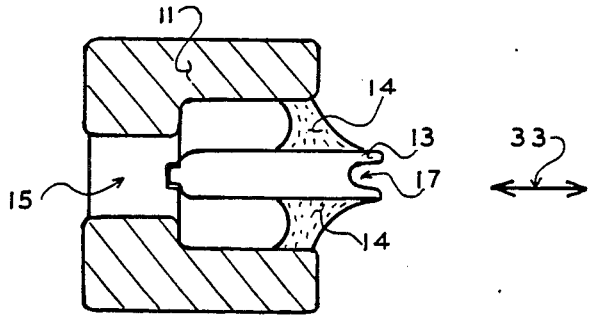
FIG. 7 comprising FIGS. 7A to 7R provides alternate embodiments of the transverse compliant edge arrangement in accordance with the present invention.

Alternate embodiments of the transverse compliant edge system will now be discussed with reference to FIG. 7. A transverse section of the frame 11 at a string support having a transverse compliant edge arrangement is shown in FIG. 7A. String support rail 13 is shown extended radially outwards 33 past racquet frame 11. Thus string 12 that is supported in string groove 17 is radially further out than if string 12 was supported at or within frame 11. This results in a strung surface larger than that possible with a similar sized racquet not benefitting from this radially extended feature. Gains in the dwell time and rebound performance can be obtained with this over-sized strung surface without penalties of a higher rotary inertia of an oversized frame. Another benefit of this radially extended feature is the tranverse compliant edge system reduces ball impact forces transmitted to frame 11. This is because a large part of the shock felt by an arm holding a racquet is caused by transverse force components of a ball's impact force; the compliant structure 14 elastically absorbs transverse impact force and thus reduces transmission of some of these forces into the racquet frame 11.

Another benefit of the transverse compliant edge system is that compliance and therefore dwell time can be individually adjusted for each string support. It may be desireable to change dwell time as a function of the distance along the racquet's longitudinal axis (the axis of the handle) over the racquet's hitting surface. A stiff racquet made of metal, fiber, wood, composites of materials, or fiber plastic compositions may require a dwell time that increases from the racquet's lower position near the handle, towards the top of frame. The transverse compliant edge system provides for selective and different dwell time adjustment as a function of position along the periphery of frame 11. Adjustment may be accomplished by selecting stiffness of each compliant structure 14. This stiffness selection directly adjusts dwell time of a ball hitting the strings affected by particular compliant structures 14. For a stiff racquet, dwell time can be increased with a stiffness gradient of separate compliant structures 14 decreasing from the bottom (near the handle) to the top away from the handle) of the hitting surface. Other stiffness gradients may be used in alternate embodiments.

Figure 7B:
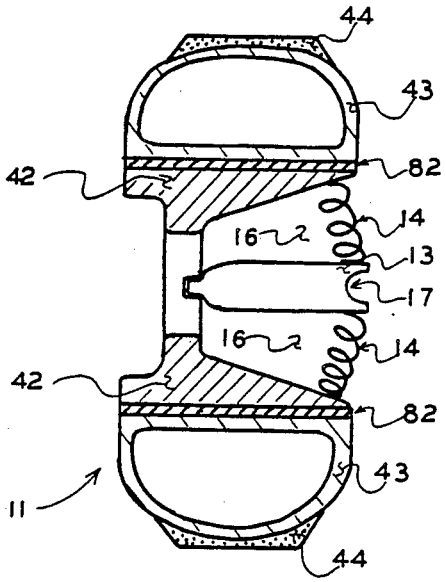

FIG. 7B shows a transverse cross-section of an alternate racquet embodiment that uses a central beam 42 to implement frame 11. Beam 42 contains an outer channel 16 for mounting the transverse compliant edge system. Beam 42 may have elongated or enlarged holes 15 to permits string 12 to move transversely Beam 42 may contain a single continuous string support rail 13 or a plurality of separate string support rails 13 that may contain string groove 17 to support string 21 and to provide for transverse motion while inhibiting radial motion of string 12. Compliant structures 14 control transverse motion and provides elastic transverse support of the string support rail 13, as discussed with reference to FIGS. 2 and 3. This embodiment may include two outer strength sections 43 and attached to each of the two transverse outer faces of beam 42. Outer strength sections 43 provide strength and stiffness for racquet frame 11. The combined structural device, sections 43 and central beam 42, can extend into and through the handle and of the racquet for continuity, strength and ease of manufacture. Reinforcement 44 can be attached to the radially outer surfaces of the two strength sections 43, either continuously or in segments to provide further reinforcement and greater transverse stiffness of the racquet. Central beam 42 may be made into an 'H', 'U', or other shape cross section for high strength and low weight. Materials such as metal, plastic, or fiber reinforced plastic, or combinations thereof may be used. Central beam 42 can be extruded, molded, cast, or machined, Outer strength sections 43 can each be made as multiple or single hollow continuous thin walled beams filled with air, gas, plastic foam or light wood or other materials. Outer strength sections 43 can be molded, bonded, or otherwise attached to central beam 42. If outer strength sections 43 and central beam 42 have materials with different temperature coefficients of expansion; a strong; high peel-strength, high shear strength adhesive, such as nitrile loaded epoxy may be used to bond 82 outer strength sections 43 to central beam 42. This provides adequate joint strength and still allows for differential temperature expansion of the different beams and sections that make up the racquet frame 11. Reinforcement 44 may be made of a material having a very high strength to weight ratio such as carbon fiber, boron fiber, glass fiber, or aromatic polyamide fiber reinforced plastics or combinations thereof. Width of outer channel 16 of the central beam 42 may be increased in the radially outward direction. This allows greater transverse movement of string support rail 13 and more room for compliant structures 14 while maintaining strength of central beam 42.

Figure 7C:
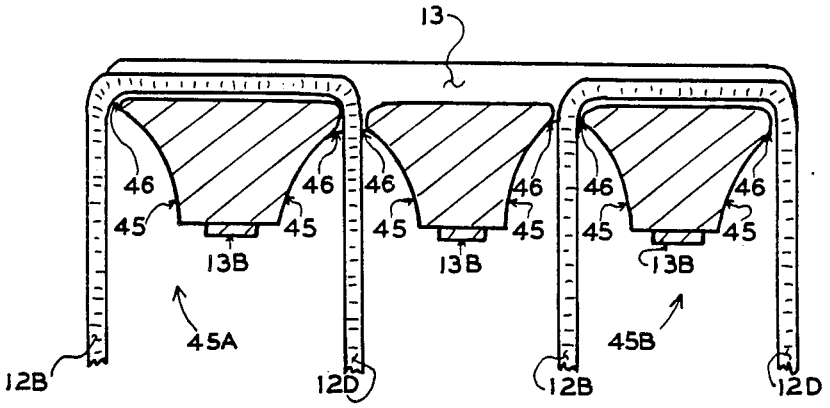

FIG. 7C shows a side view of a section of an alternate embodiment of string support rail 13. String support rail 13 may support two loops 45A and 45B of the string. Length of string support rail 13 can vary from a short segment supporting a single loop of string (FIG. 2) to a continuous rail supporting many loops of string and in one embodiment all of the loops of string. A racquet may use a string support rail 13 of identical short lengths for convenience and may vary the stiffness of the compliant structures for providing transverse elastic properties of the string support as a function of position on racquet frame 11. Foot 45 of string support rail 13 is the portion of string support rail 13 that is the radially inwards part of the string support rail 13. It may be implemented in various forms such as the form shown in the side view shown in FIG. 7C receding away from rounded edges 46 of string support rail 13 over which the string passes to be supported by string support rail 13. This design allows free range of the string 12, therefore reducing friction when string support rail 13 rotates.

Figure 7D:
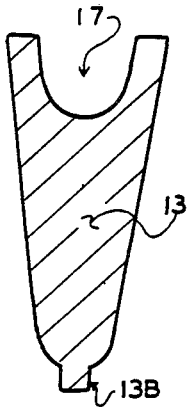
Figure 7E:
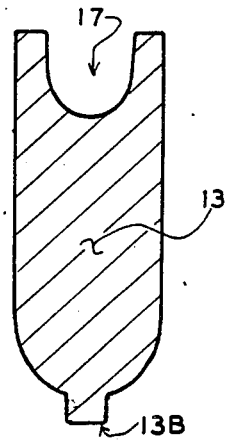
Figure 7F:
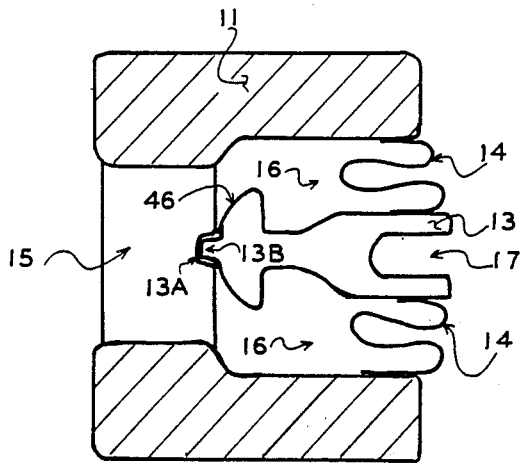
Figure 7G:
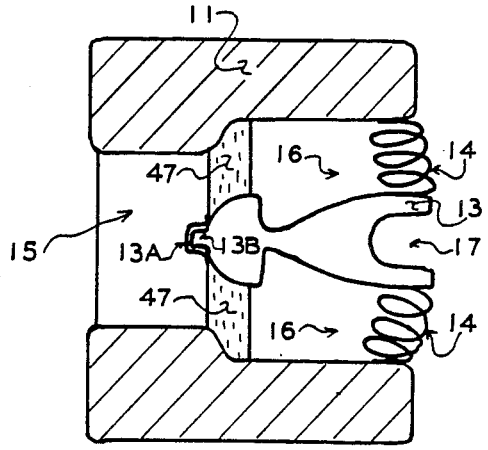
Figure 7H:
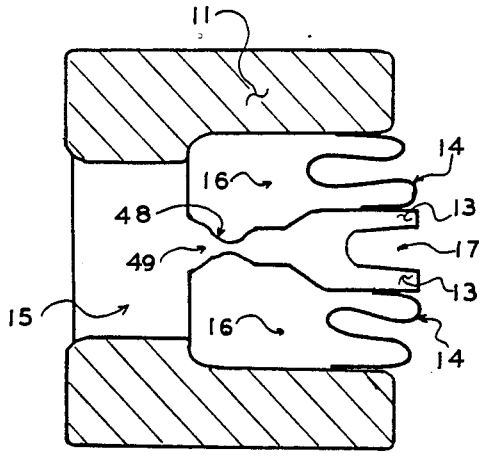
Figure 7I:
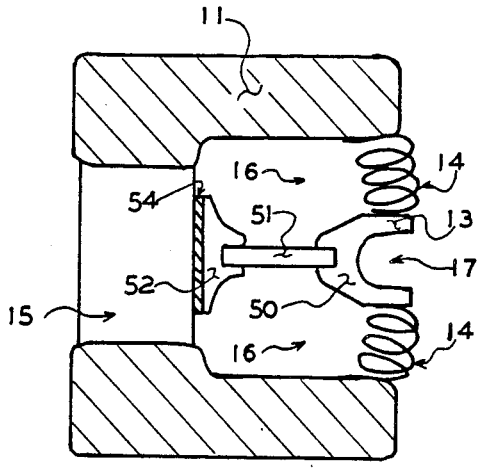
Figure 7J:
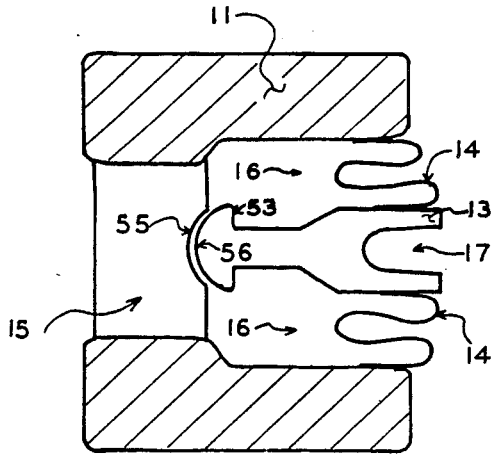
Figure 7K:
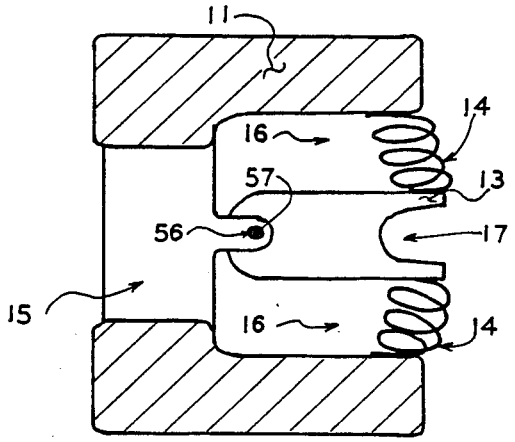
Figure 7L:
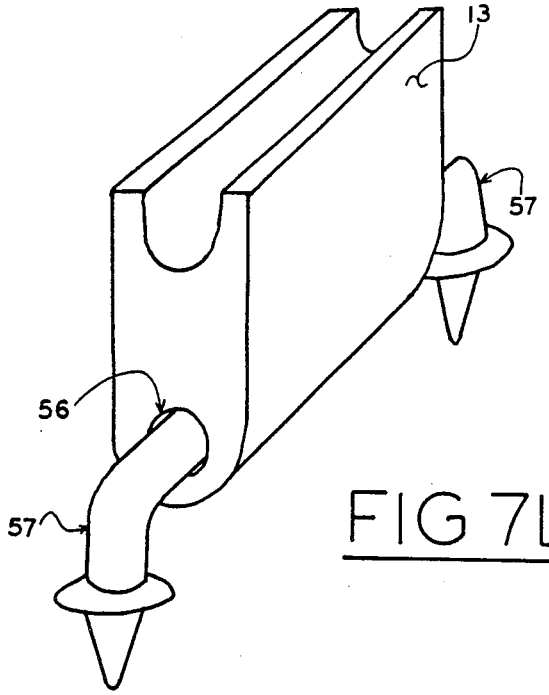
Figure 7M:
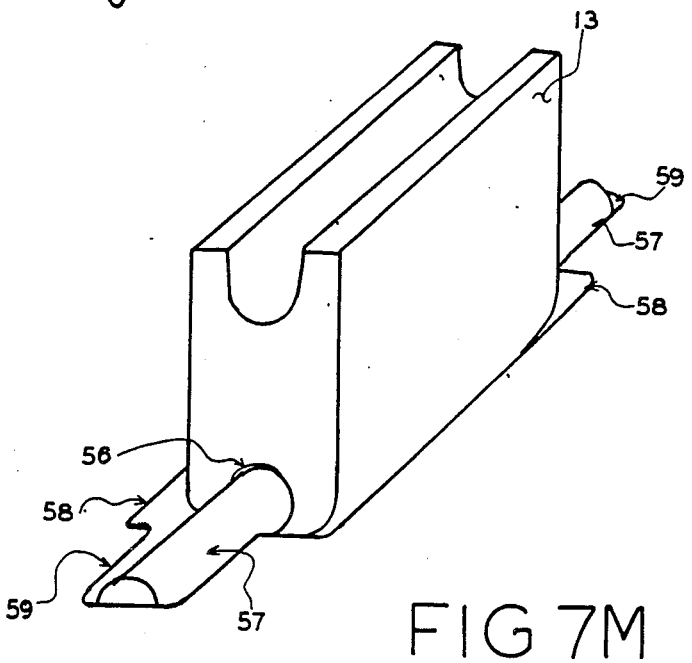
Figure 7N:
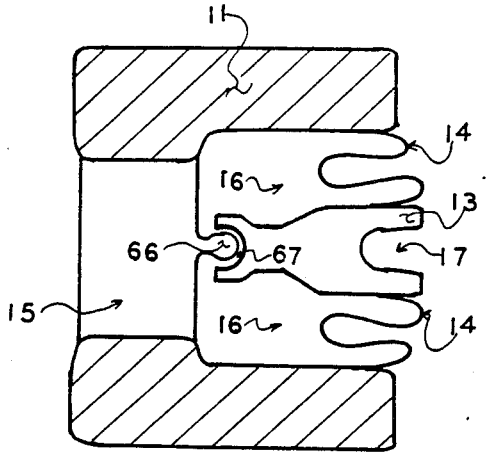
Figure 7O:
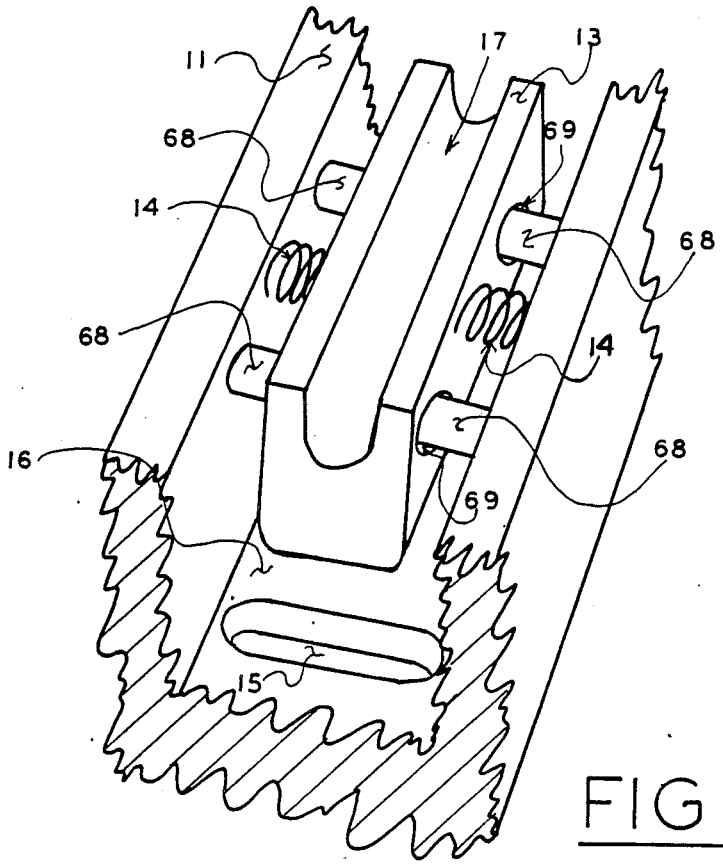
Figure 7P:
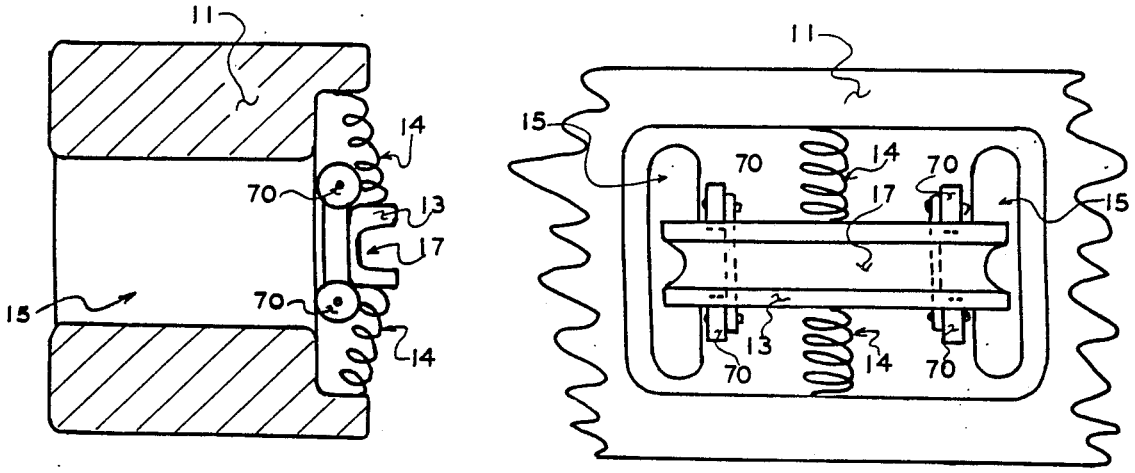
Figure 7Q:
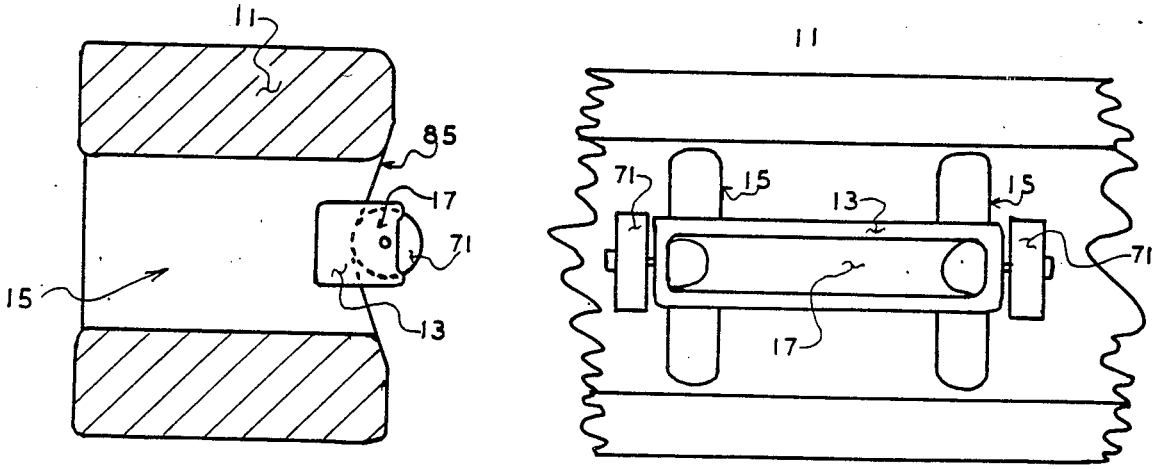
Figure 7R:
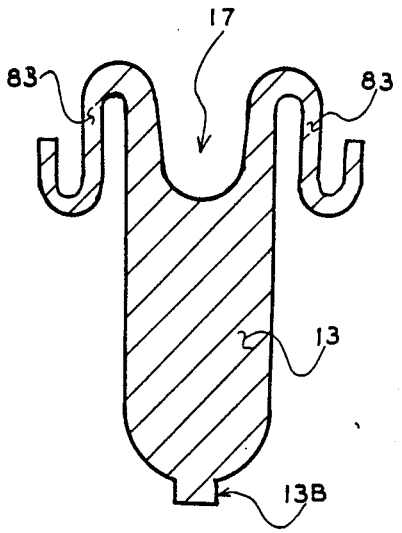

FIGS. 7D, 7E, and 7R shows alternate embodiments of transverse sections or cross-sections of the support rail having groove 17. any of these embodiments may be used in the arrangements discussed herein such as with reference to FIGS. 3 and 7B. FIG. 7R shows an alternate embodiment of string support rail 13 where compliant structures 14 may be integral parts of string support rail 13 and proper transverse compliance may be provided by configuring the thickness and shape of transverse protruderances 83 from the rail that act as the transverse compliant structures. Configuration of the rail compliant structures can be molded or extruded as a single part out of metal or plastic or rubber or other material or requisite strength and elasticity. String support rail 13 may be made of extruded or machined metal such as aluminum, but can also be made of other materials such as a strong rigid plastic or fiber plastic composite or hard rubber.

FIGS. 7F to 7Q show alternate embodiments of the transverse compliant edge system arrangement. These alternate arrangements will now be discussed. Different compliant structures are drawn, such as spiral and bent leaf springs. Any such arrangement may be suitable and are often equivalent in their actions and are therefore used interchangeably herein.

FIG. 7F shows a transverse section of frame 11 using string support rail 13 having a shaped or rounded foot 46 for contacting frame 11. Rounded foot 46 which may contain a ball and socket arrangement 13A and 13B as discussed herein with reference to FIG. 3B provides an efficient pivot as the string support rail 13 rotates. This rounded foot arrangement has important advantages. For example rounded foot 46 provides a larger contact area 86 with the frame 11, thus reducing wear and deformation of contact surfaces. Also, rounded foot 46 can be shaped to reduce radial motion of string groove 17 caused by geometry of rotation of string support rail 13 and by material compressions in string support rail 15 and in racquet frame 11.

FIG. 7G shows a transverse section of an alternate transverse compliant system embodiment where a compliant material 47 is located about the radially inwards portion of the string support rail 13. This feature allows compliant material 47 to support string support rail 13 in the center of outer channel 16 and also provide transverse elastic support that allows elastic rotation of string support rail 13. A ball and socket arrangement 13A and 13B discussed herein with reference to FIG. 3B may be included at the radially inner part of string support rail 13.

FIG. 7H shows a transverse section of an alternate transverse compliant edge system embodiment, where string support rail 13 is an integral part of a single or multiple hollow section beam that form frame 11. Elastic transverse movement of string support rail 13 results from elastic bending of parts of its structures especially in the region of the main beam 48. Main beam 48 of string support rail 13 may be a thin or narrow segment between the radially outer part that contains string groove 17 and the radially inner part 49 that connects into frame 11. Main beam 48 may be stiff in the radial direction and may be flexible in the transverse direction to facilitate transverse elastic movement. Additional transverse support can be provided by adding compliant structures 14 such as between the protruderance that is string support rail 13 and the walls of outer channel 16, or by extruding the compliant structures 14 as an integral part of string support rail 13. This embodiment can be formed from extruded metal, plastic, or other materials.

FIG. 7I shows a transverse section of an alternate transverse compliant system embodiment having a string support rail 13 that contains a transverse spring member 51. Spring member 51 can be made of various materials including metal or fiber reinforced plastic. It can be constructed thin in the transverse direction and wide in the radial and peripheral directions for improved spring action. The best dimensions of the spring member 51 can have dimensions that are a function of the strength and stiffness of its material and can be chosen to make string support rail 13 stiff in the radial direction, flexible in the transverse direction, and with strength to retard its buckling under radial loads caused by the string 12 under tension that is being supported in string groove 17. Spring member 51 may be bonded or mechanically attached at the radially inwards part with foot section 52 having a surface that is bonded 54 to frame 11 inside outer channel 16. The radially outwards part of spring member 51 may be bonded or mechanically attached to a groove section 50 containing a string groove 17 parallel to the peripheral direction of the edge of racquet frame 11 containing and supporting string 12. The transverse spring action of spring member 51 provides transverse elastic movement and inhibits radial movement of the strings 12. Additional compliant structures 14 can be added in the manner described with reference to FIG. 3 to supplement compliance of spring member 51 providing increased control of transverse elastic characteristics of the transverse compliant edge system.

FIG. 7J shows a transverse section of an alternate transverse compliant edge system embodiment. String support rail 13 includes foot section 53 and the radially inward part of string support rail 13. Foot section 53 may include a rounded surface 56 for contacting racquet frame 11 at the radially inwards part of outer channel 16. A contact channel or groove 55 may be formed at contact area in racquet frame 11. Contact channel 55 may have a transverse cross-section that fits rounded surface 56 of foot section 53 of string support rail 13. Foot section 53 of string support rail 13 and contact channel 55 may form a 'ball and socket' type arrangement Contact channel 55 can have walls or obstructions along its length that is in the direction parallel to the periphery of the frame 11 to provide support and to limit movement of string support rail 13 in a direction parallel to the periphery of racquet frame 11. The 'ball and socket' arrangement shown in FIG. 7J reduces translational movement of foot section 53 of string support rail 13, thus reducing friction losses and allowing rotation or pivoting of string support rail 13.

FIG. 7K shows a transverse section of an alternate embodiment of the transverse compliant edge system. The radially inwards part of string support rail 13 has hole or groove 56 aligned along the length of string support rail 13 parallel with peripheral edge of racquet frame 11. A pin or a long thin cylinder 56 fits into hole 56 and acts as a pivot for rotation of string support rail 13. This arrangement inhibits translational movement of the radially inwards position of string support rail 13 while allowing rotation of string support rail 13. Pin 56 can be constructed of metal such as steel or can be constructed of a strong metal-plastic composite structure for strength and low friction. Compliant structures 14 provide for the elastic transverse movement of string support groove 17. FIG. 7L shows an embodiment of the pin pivot of FIG. 7K in greater detail. Pin 57 is shown having 90° bent ends for anchoring into racquet frame 11. FIG. 7M shows another embodiment of the pin pivot of FIG. 7K in greater detail. Pin 57 is shown straight having ends bonded onto racquet frame 11. One method of constructing is to bond the ends of pin 57 into fitting grooves 59 in racquet frame 11. The radially inwards part of string support rail 13 can be implemented to clear racquet frame 11 such as with a deeper groove 58 being formed in racquet frame 11 along string support rail 13. This arrangement provides clearance for rotation of string support rail 13. This arrangement inhibits translational motion of the radially inwards portion of string support rail 13 and allows the desired rotation of the string support rail 13.

FIG. 7N shows a transverse section of an alternate embodiment of the transverse compliant edge system. String support rail 13 pivots on protruderance 66 from racquet frame 11. The radially outer part of the protruderance 66 fits into groove 67 along the peripheral direction in the radially inner part of string support rail 13. A 'ball and socket' pivot arrangement is thus provided. Alternately, protruderance 66 can be shaped to contain a groove on the radially outer part which the radially inner part of string support rail 13 can fit into forming an alternate ball and socket pivot. Compliant structures 14 provide elastic transverse support for string support rail 13 in a manner similar to that described with reference to FIG. 3.

FIG. 7O shows an alternate embodiment of the transverse compliant edge system. A transversely sliding string support rail 13, containing a string groove 17 to support string 12, slides on one or more transverse pins 68 that are anchored into frame 11. Transverse pins 68 fit loosely into transverse holes or grooves 69 in string support rail 13. Compliant structures 14 are shown in FIG. 7O as spiral springs but may be formed in many other ways. Compliant structures 14 placed between string support rail 13 and the walls of outer channel 16 provide transverse elastic movement of the string support rail 13 through compression and elongation. Transverse pins 68 inhibit radial and peripheral movement while allowing transverse movement of string support rail 13. This 'sliding pin' arrangement for string support rail 13 shown in FIG. 7O may have higher friction losses than the pivot arrangement discussed with reference to FIG. 3 herein. However, it provides advantages such as allowing a shallower outer channel 16 for greater strength and stiffness of racquet frame 11.

FIG. 7F shows a transverse section of an alternate embodiment of transverse compliant edge system. String support rail 13 contains rollers, which may be implemented as a single roller or multiple rollers 70. Rollers 70 may be constructed of materials such as metal or plastic. Roller 70 may be aligned to roll in the transverse dirdction on racquet frame 11. Therefore, string support rail 13 can be free to move in the transverse direction in response to the transmitted transverse force of a hit ball and can be inhibited to move in the radial direction. String support rail 13 may be attached to compliant structures 14 and compliant structures 14 can be attached to racquet frame 11. Compliant structures 14 provide elastic transverse motion of string support rail 13 (and hence the string 12 being supported in string groove 17) in the radially outer part of string support rail 13 by compressing and elongating.

FIG. 7Q shows a transverse section of an alternate embodiment of the transverse compliant edge system. String support rail 13 may have attached a single roller or multiple rollers. Roller 71 may be aligned to roll in a direction along the narrow part of string support rail 13 in the transverse direction. The radially outwards surface 85 of frame 11 may be the contact surface for roller 71 and may have a concave transverse outer section. Therefore, roller 71 may be at a minimum radial distance from the center of the racquet when the roller 71 is at the transverse center of racquet frame 11. Hence string support rail 13 is located at the transverse center, which is in the plane formed by the quiescent strung surface of the racquet frame 11. String 12 being supported by string support rail 13 is under tension. Therefore, string 12 holds roller 71 against concave contact surface 85 of racquet frame 11. The transverse component of the impact force of the ball forces string support rail 13 to move in the transverse direction. This motion is permitted by roller 71 rolling upon racquet frame 11. However, tension forces of string 12 tend to pull roller 71 and hence tend to pull string support rail 13 back into the radially inward part of concave surface 85. This is an equilibrium position of minimum string 12 stretch and hence of minimum potential energy of strings 12. Transverse motion of string support rail 13 is elastic because the strings themselves act as the transverse compliant structures through action of roller 71 on concave surface 72 which translates the radial forces of string 12 into transverse compliant forces. The concave contact surface 85 inhibits radial motion of string support rail 13 and its string groove 17. FIG. 7Q shows that string support rail 13 can be structured to have string groove 17 located in the radial direction at the axis of roller 71. Alternately string support groove 17 can be located radially inwards from roller 71. This provides greater stability for string support rail 13 at large transverse movements of string 17.

With the benefits gained from the transverse compliant edge system; a racquet and a string can be designed for higher power than racquets and strings not having the benefits thereof. These benefits are gained without losing the advantages of ball control and spin. This is due to the increase in dwell time without introducing significant new losses with the transverse compliant edge system. A design for high power may involve a very stiff racquet. It is particularly important to make the racquet stiff in the transverse direction. This transverse stiffness is inversely proportional to the transverse deflection of the racquet, extended horizontally with the string surface parallel to the ground and supported at the handle, when a constant weight is suspended at the top of the racquet (the part furthest away from the supported handle).

Figure 8A:
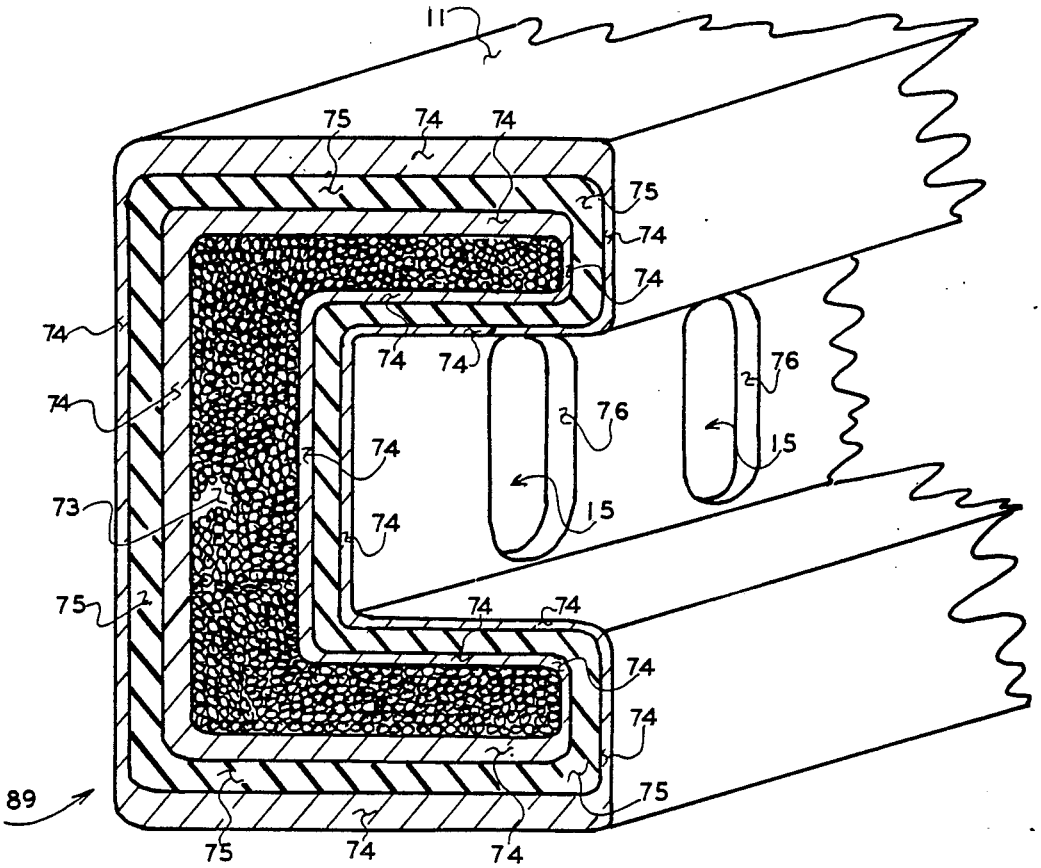
FIGS. 8A and 8B illustrates construction of a racquet in accordance with the present invention.

Construction of a very stiff racquet containing deep outer channel 16 and a plurality of elongated holes 15 can be difficult. However a very stiff racquet may greatly benefit from using the transverse compliant edge system. Therefore, a new racquet construction technique will now be discussed with reference to FIG. 8A. An off-angle view of a cross section of one embodiment of a stiff racquet frame is shown in FIG. 8A. The racquet may be constructred of a single continuous beam 89 that is bent into the desired shape of a racquet frame. A series of outer cavities on a continuous outer channel 16 may be formed at the places where transverse elastic string support is desired. A single cross piece 86 or several cross pieces 86 can be added in the racquets throat area between the handle 10 and the frame 11. The beam can contain a high strength plastic foam core 73 or an expendable plastic or fiber hose covered with layers of epoxy impregnated car on fiber. Longitudinal layers 74 next to foam core 73 can be made of epoxy impregnated carbon fiber. The fiber can be primarily oriented along the length of the beam 89 which is the peripheral direction along racquet frame 11. A cross layer of epoxy impregnated carbon fiber 75 can be wrapped in a criss-cross fashion over the inner foam core 73 and the inner longitudinal layers 74. Longitudinal layers 74 can be placed over cross layers 75 on transversely outward surfaces of beam 89 and the radially inwards and outwards surfaces. Elongated holes 15 can be cut in beam 89 after it is shaped into racquet frame 11. Hole reinforcement 76 may be made of metal, plastic or fiber plasic composite and may be added at and around elongated holes 51 to provide reinforcement and prevent stress cracks from forming. The longitudinal layers 74 can be from 0.005 to 0.10 inches thick and cross layers 75 can be from 0.010 to 0.100 inches thick, adding up to total epoxy impregnated carbon fiber composite layer from 0.010 to 0.250 inches thick.

Figure 8B:
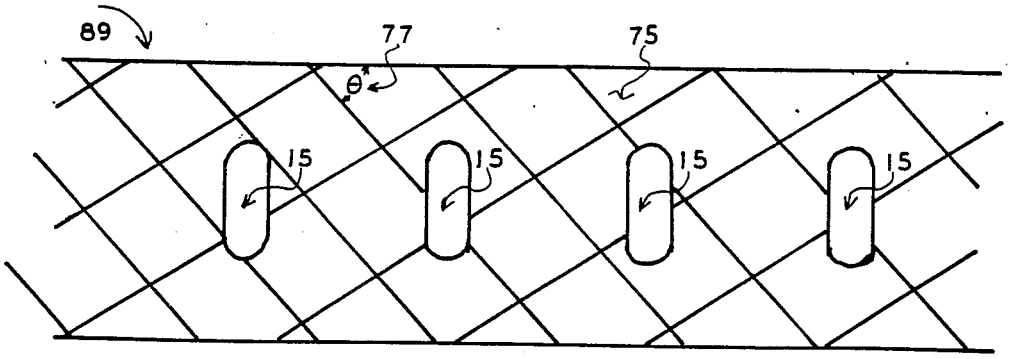

FIG. 8B shows that manner in which the cross layer 75 is wrapped. Bias 77 of the carbon fiber is the angle with the carbon fiber makes to the direction parallel to the longitudinal direction of beam 89. Carbon fiber is wrapped at a bias 77 of from 20° to 70°. For example, first in one direction and then the other direction along the length of beam 75. This forms a cross pattern, shown in FIG. 8B. This process is repeated until the desired thickness is built up. Cross layer 75 together with the longitudinal layers 74 provides a strong and stiff beam 89 even when the elongated string holes 15 are cut and the beam contains deep cavities 16 or channels 16.

The complete beam 89 is bent into shape of the racquet and placed into a mold while the epoxy is uncured and soft. A pressure of from 1 pounds per square inch to 200 pounds per square inch is applied by pressing parts of the mold, such as parts to form outer channel 16, or by expanding the inner core 73 by forcing in air or liquid to create pressure. The epoxy is cured by applying heat to bind the carbon fiber into a strong, stiff, and light racquet frame 11 structure.

From the above description it will be apparent that there is thus provided a device of the character described possessing the particular features of advantage enumerated as desireable, but which is susceptible to modification in its form, method, mechanization, operation, detailed construction and arrangement of parts without departing from the principles involved or sacrificing any of its advantages.

While in order to comply with the statutes, the invention has been described in language specific as to structural features, it is intended that the invention not be limited to the specific features shown, but that the means, method, and construction disclosed herein comprise the preferred form of various modes of putting the invention into effect and the invention is therefore claimed in any of its forms or modifications within the legitimate and valid scope of the appended claims.

What I claim is:

1. A compliant system comprising:

a string for interacting with an object;

transverse compliance means for providing transverse compliance of said string in response to interaction with an object, wherein said transverse compliance means includes (a) a string support rail for providing transverse motion of said string, (b) a pin for attaching said string support rail to a frame structure, and (c) elastic material for providing transverse compliance of said string in response to the transverse motion; and a frame structure for mounting said transverse compliance means.

2. The system as set forth in claim 1 above, further comprising means for reducing radial motion.

3. The system as set forth in claim 2 above, wherein said transverse compliance means and said radial motion reducing means are constructed with a pivot having a pivotal axis that permits motion in the transverse direction and having a rigid support that inhibits motion in the radial direction.

4. The system as set forth in claim 2 above, wherein said transverse compliance means and said radial motion reducing means are constructed with a roller having a rolling axis in the transverse direction and having a rigid support in the radial direction.

5. The system as set forth in claim 1 above, wherein said frame structure comprises a racquet frame for supporting said transverse compliance means, said racquet frame including a plurality of holes for passing said string therethrough, wherein said holes are elongated in the transverse direction to reduce friction due to transverse motion.

6. The system as set forth in claim 2 above, wherein said string is arranged in a planar form, wherein said radial motion reducing means is arranged to maintain the planar form of said string by reducing radial motion, and wherein said transverse compliance means is arranged to provide the transverse motion of said planar form string in response to interacting with an object.

7. The system as set forth in claim 2 above, wherein said string has relatively greater friction due to radial motion and relatively lower friction due to transvese motion, wherein said radial motion reducing means inhibits the greater friction-related radial motion, and wherein said transverse compliance means permits the lower friction-related transverse motion for improved motion with reduced friction.

8. A compliant system comprising:

a string for interacting with an object;

transverse compliance means for providing transverse compliance of said string in response to interaction with an object, wherein said transverse compliance means includes (a) a string support rail for supporting said string, (b) a roller for providing transverse motion of said string by rolling on a frame structure, and (c) elastic material for providing transverse compliance of said string in response to the transverse motion; and a frame structure for supporting said roller.

9. The system as set forth in claim 8 above, wherein said frame structure includes (1) an outer surface for supporting said roller and (2) means for mounting said roller to roll on said outer surface.

10. The system as set forth in claim 8 above, wherein said frame structure includes (1) a concave outer surface for supporting said roller and (2) means for mounting said roller to roll on said concave outer surface.

11. The system as set forth in claim 8 above, wherein said frame structure comprises a racquet frame for supporting said transverse compliance means, said racquet frame including a plurality of holes for passing said string therethrough, wherein said holes are elongated in the transverse direction to reduce friction due to transverse motion.

12. A racquet system comprising:

a string arrangement for hitting a ball;

transverse compliance means for providing transverse compliance of said string arrangement in response to hitting of a ball; and a frame for supporting said transverse compliance means, said frame including a plurality of holes elongated in the transverse direction for passing string from said string arrangement therethrough.

13. A racquet system comprising:

a string arrangement for hitting a ball;

a pivot for supporting said string arrangement;

transverse compliant means for permitting transverse motion of said pivot supported string arrangement in response to hitting a ball, wherein said pivot is supported in the transverse direction with compliant material; and radial support means for inhibiting radial motion of said pivot supported string arrangement with a rigid radial support in response to hitting a ball, wherein said pivot is supported in the radial direction by rigid material.

14. A racquet system comprising:

a string arrangement for hitting a ball;

a roller for supporting said string arrangement;

transverse compliant means for permitting transverse motion of said roller supported string arrangement in response to hitting a ball, wherein said roller has an axis of rolling supported with compliant material in the transverse direction; and radial support means for inhibiting radial motion of said roller supported string arrangement with a rigid radial support in response to hitting a ball, and wherein said roller cannot roll in the radial direction and is supported by rigid material in the radial direction.

15. A racquet system comprising:

a string arrangement for hitting a ball;

transverse compliant means for permitting transverse motion of said string arrangement with a transverse compliance support in response to hitting a ball;

radial support means for inhibiting radial motion of said string arrangement with a rigid radial support in response to hitting a ball; and a racquet frame for supporting said transverse compliant means and said radial support means, said frame including a plurality of holes for passing string therethrough, wherein said holes are elongated in the transverse direction to reduce friction due to transverse motion.

16. A racquet comprising;

string means for hitting a ball;

a pivot for supporting said string means;

elastic means for providing elastic transverse movement of said pivot supported string means, wherein said pivot is supported in the transverse direction with elastic material; and rigid means for inhibiting radial movement of said pivot supported string means, wherein said pivot is supported in the radial direction with rigid material.

17. A racquet comprising:

string means for hitting a ball;

a pivot for supporting said string means;

elastic means for providing compliant pivotal motion in a transverse direction; and rigid means for providing rigid support for said pivot in a radial direction.

18. A racquet system comprising a string arrangement having a plurality of strings for hitting a ball and means for reducing friction between strings by permitting transverse motion and by inhibiting radial motion in response to hitting of a ball, wherein said friction reducing means includes pivot means oriented for pivotal motion in the transverse direction and oriented for rigid support in the radial direction.

19. A racquet system comprising:

a string arrangement having a plurality of strings for hitting a ball and means for reducing friction between strings by permitting transverse motion and by inhibiting radial motion in response to hitting a ball, wherein said friction reducing means includes roller means oriented for rolling motion in the transverse direction and oriented for rigid support in the radial direction.

* * * * *